US010712070B1

(12) United States Patent
Touchton

(10) Patent No.: US 10,712,070 B1
(45) Date of Patent: Jul. 14, 2020

(54) NESTABLE SUNSHADE COOLERS

(71) Applicant: Randall W. Touchton, Converse, LA (US)

(72) Inventor: Randall W. Touchton, Converse, LA (US)

( * ) Notice: Subject to any disclaimer, the term of this patent is extended or adjusted under 35 U.S.C. 154(b) by 94 days.

(21) Appl. No.: 15/997,798

(22) Filed: Jun. 5, 2018

(51) Int. Cl.

| | |
|---|---|
| ***B65D 21/032*** | (2006.01) |
| ***F25D 3/08*** | (2006.01) |
| ***F25D 21/14*** | (2006.01) |
| *F25D 25/02* | (2006.01) |
| *B65D 81/38* | (2006.01) |
| *B65D 1/40* | (2006.01) |

(52) U.S. Cl.
CPC ..... *F25D 3/08* (2013.01); *F25D 21/14* (2013.01); *B65D 1/40* (2013.01); *B65D 81/3816* (2013.01); *B65D 81/3827* (2013.01); *F25D 25/02* (2013.01); *F25D 2303/081* (2013.01); *F25D 2331/804* (2013.01); *F25D 2400/22* (2013.01); *F25D 2500/02* (2013.01)

(58) Field of Classification Search
CPC ..... B65D 21/0233; B65D 51/28; B65D 51/2807; B65D 25/04
USPC ..... 220/735, 212, 521
See application file for complete search history.

(56) References Cited

U.S. PATENT DOCUMENTS 3,623,622 A * 11/1971 Sullivan ..... B65D 55/02 215/213
3,667,708 A * 6/1972 Smeltzer ..... A01K 97/10 248/512
6,626,006 B1 9/2003 Tedder
6,978,909 B2 * 12/2005 Goetzinger ..... F24F 13/222 220/571
7,267,229 B2 * 9/2007 Chen ..... B65D 19/06 206/386
7,313,928 B2 1/2008 Girard
(Continued)

*Primary Examiner* — Stephen J Castellano
(74) *Attorney, Agent, or Firm* — R. Keith Harrison

(57) ABSTRACT

Nestable sunshade coolers may include a cooler enclosure including an enclosure bottom panel, a pair of spaced-apart enclosure side panels extending from the enclosure bottom panel, an enclosure front panel and an enclosure rear panel extending from the enclosure bottom panel in spaced-apart relationship to each other between the enclosure side panels. A plurality of enclosure corners may join the enclosure side panels to the enclosure front panel and the enclosure rear panel to the enclosure side panels, respectively. An enclosure rim may be provided on the enclosure side panels, the enclosure front panel and the enclosure rear panel. The enclosure side panels, the enclosure front panel and the enclosure rear panel may angle outwardly from the enclosure bottom panel to the enclosure rim to form a substantially trapezoidal shape in longitudinal sectional view and cross-sectional view of the cooler enclosure. Accordingly, multiple ones of the cooler enclosure may be capable of substantially completely nesting inside one another for space-efficient stowage purposes. At least one accessory mount assembly may be carried by the cooler enclosure. The at least one accessory mount assembly may be suitably configured to removably mount at least one accessory on the cooler enclosure. A cooler lid may be selectively detachably carried by and deployable between open and closed positions on the cooler enclosure to open and close the enclosure interior.

18 Claims, 26 Drawing Sheets

(56) References Cited

U.S. PATENT DOCUMENTS

| | | | | |
|---|---|---|---|---|
| 8,065,889 | B1 | 11/2011 | Silberman | |
| 8,528,743 | B1 | 9/2013 | Rains | |
| 8,800,317 | B2 | 8/2014 | Dallas et al. | |
| 8,960,470 | B2 | 2/2015 | Tarble et al. | |
| 2004/0206759 | A1* | 10/2004 | Busch | B65F 1/1615 220/315 |
| 2005/0006268 | A1* | 1/2005 | Futernick | B65D 21/0233 206/518 |
| 2016/0113370 | A1* | 4/2016 | Arel, Jr. | A45C 15/00 220/592.09 |
| 2017/0251643 | A1* | 9/2017 | Boudreau | B65D 21/0233 |

* cited by examiner

NESTABLE SUNSHADE COOLERS

FIELD

Illustrative embodiments of the disclosure generally relate to ice chests and the like. More particularly, illustrative embodiments of the disclosure relate to nestable sunshade coolers which are capable of being nested within one another to save space and which may facilitate attachment of various accessories to the coolers.

BACKGROUND

The background description provided herein is solely for the purpose of generally presenting the context of the illustrative embodiments of the disclosure. Aspects of the background description are neither expressly nor impliedly admitted as prior art against the claimed subject matter.

Ice chests and the like are commonly used to maintain foods and beverages in a cold condition until consumption. One of the drawbacks of existing ice chest designs, however, is that storage of multiple ice chests typically requires that the ice chests be stacked on top of one another on a shelf in a retail setting or by a consumer in a garage, closet or other home storage area. The stacked ice chests commonly occupy a large volume of space which could be used for other purposes.

Accordingly, nestable sunshade coolers which are capable of being nested within one another to save space and which may facilitate attachment of various accessories to the coolers may be desirable for some applications.

SUMMARY

Illustrative embodiments of the disclosure are generally directed to nestable sunshade coolers which are capable of being nested within one another to save space and which may facilitate attachment of various accessories to the coolers. An illustrative embodiment of the nestable sunshade coolers may include a cooler enclosure including an enclosure bottom panel, a pair of spaced-apart enclosure side panels extending from the enclosure bottom panel, an enclosure front panel and an enclosure rear panel extending from the enclosure bottom panel in spaced-apart relationship to each other between the enclosure side panels. A plurality of enclosure corners may join the enclosure side panels to the enclosure front panel and the enclosure rear panel to the enclosure side panels, respectively. An enclosure rim may be provided on the enclosure side panels, the enclosure front panel and the enclosure rear panel. The enclosure side panels, the enclosure front panel and the enclosure rear panel may angle outwardly from the enclosure bottom panel to the enclosure rim to form a substantially trapezoidal shape in longitudinal sectional view and cross-sectional view of the cooler enclosure. Accordingly, multiple ones of the cooler enclosure may be capable of substantially completely nesting inside one another for space-efficient stowage purposes. At least one accessory mount assembly may be carried by the cooler enclosure. The at least one accessory mount assembly may be suitably configured to removably mount at least one accessory on the cooler enclosure. A cooler lid may be selectively detachably carried by and deployable between open and closed positions on the cooler enclosure to open and close the enclosure interior.

BRIEF DESCRIPTION OF THE DRAWINGS

Illustrative embodiments of the disclosure will now be described, by way of example, by reference to the accompanying drawings, wherein.

DETAILED DESCRIPTION

Figure 1:
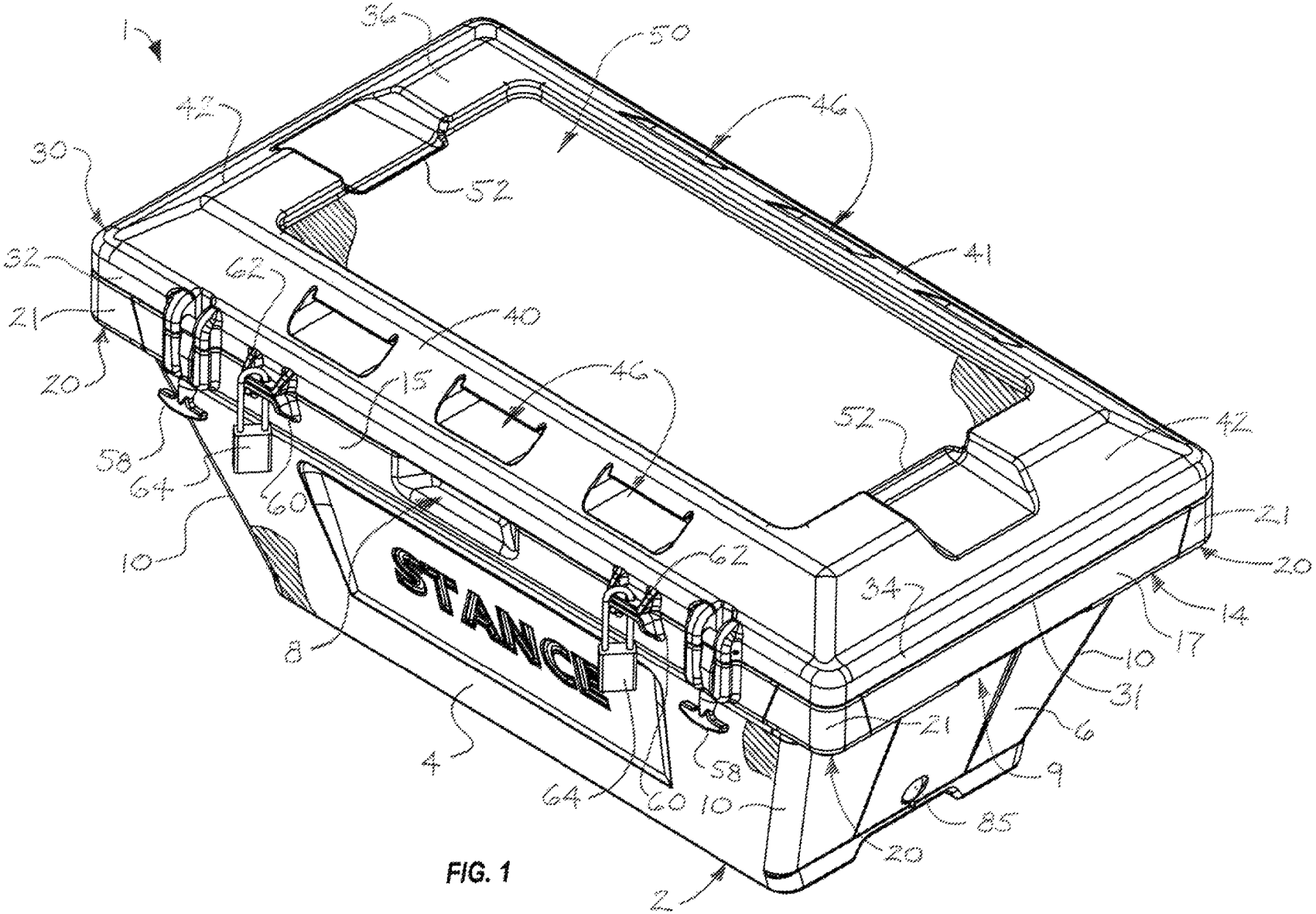
FIG. 1 is a typical front perspective view of an illustrative embodiment of the nestable sunshade coolers, with the cooler lid closed on the cooler enclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-17 and 24 of the drawings, an illustrative embodiment of the nestable sunshade coolers is generally indicated by reference numeral 1. The nestable sunshade cooler 1 may include a cooler enclosure 2. The cooler enclosure 2 may include an enclosure bottom panel 3. An enclosure front panel 4 and an enclosure rear panel 5 may extend upwardly from the enclosure bottom panel 3. A pair of spaced-apart enclosure side panels 6 may extend upwardly from the enclosure bottom panel 3 between the enclosure front panel 4 and the enclosure rear panel 5.

Figure 8:
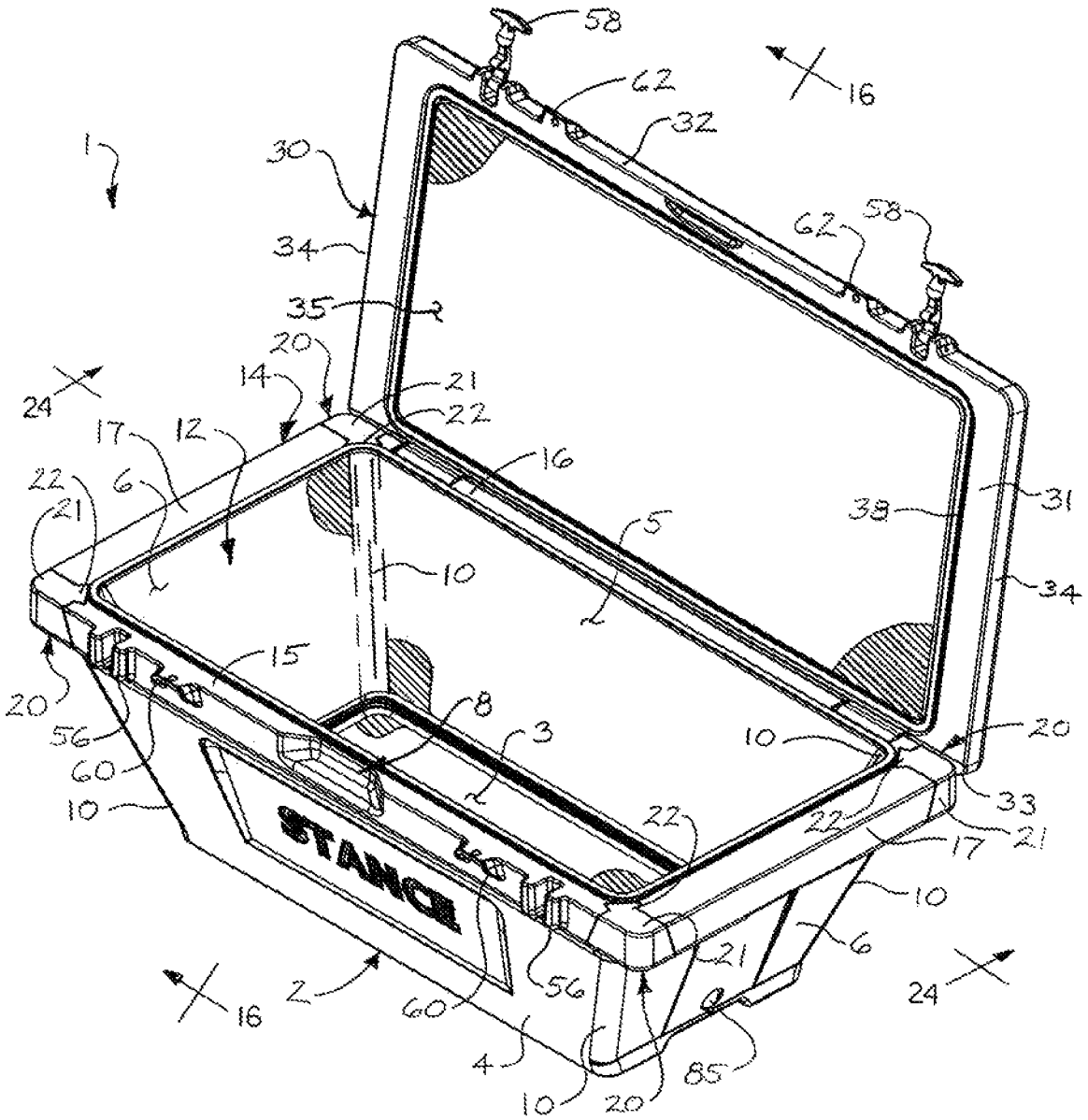
FIG. 8 is a typical front perspective view of the illustrative nestable sunshade cooler with the cooler lid opened on the cooler enclosure.

As illustrated in FIG. 8, an enclosure rim 14 may extend along the upper edges of the respective enclosure front panel 4, enclosure rear panel 5 and enclosure side panels 6. The enclosure rim 14 may include a front rim segment 15, a rear rim segment 16 and a pair of side rim segments 17 which extend along the upper edges of the respective enclosure front panel 4, enclosure rear panel 5 and enclosure side panels 6. An enclosure interior 12 may be formed by and between the enclosure bottom panel 3, the enclosure front panel 4, the enclosure rear panel 5 and the enclosure side panels 6.

Figure 14:
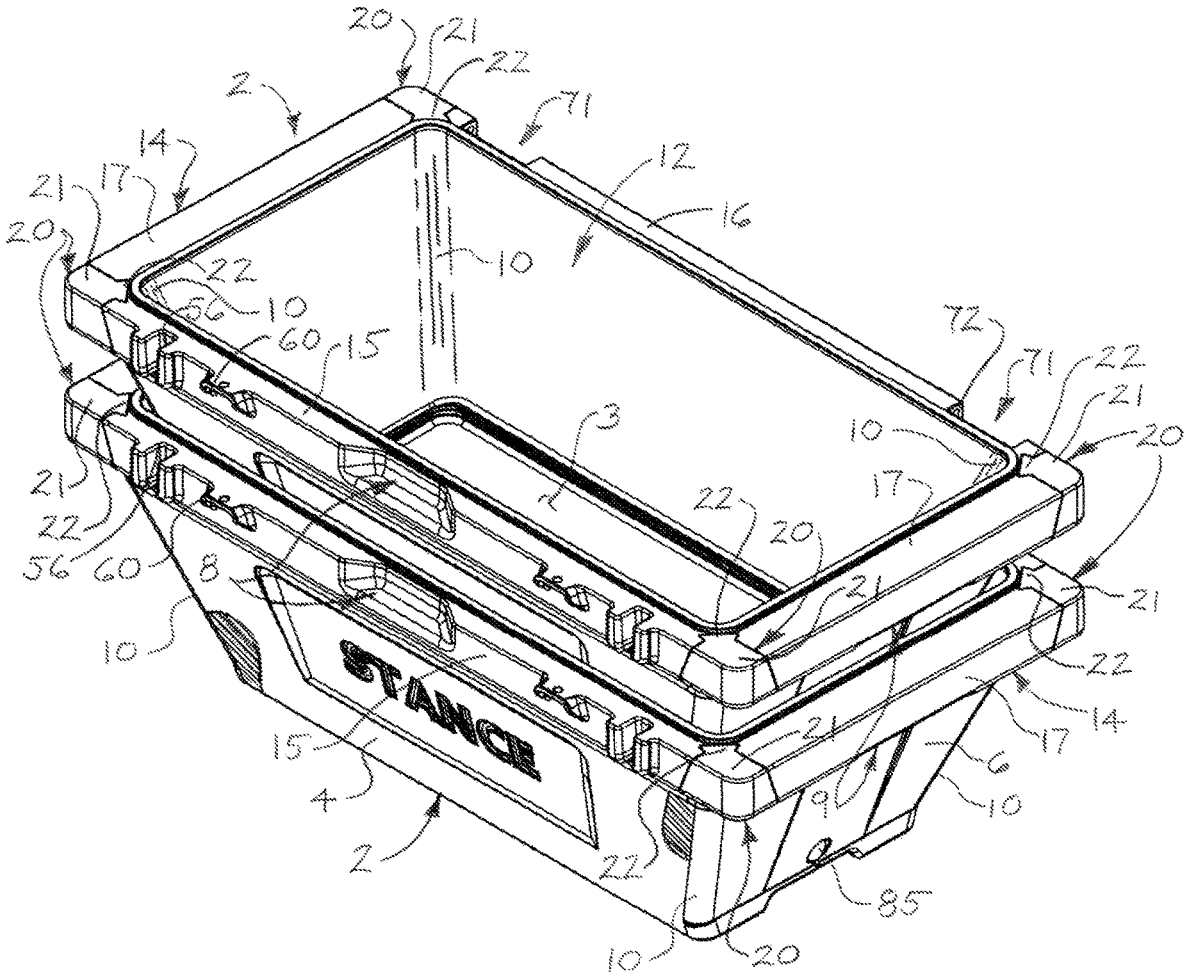
FIG. 14 is a front perspective view of a pair of cooler enclosures of the nestable sunshade cooler, shown in nested configuration with each other typically for storage purposes.
Figure 15:
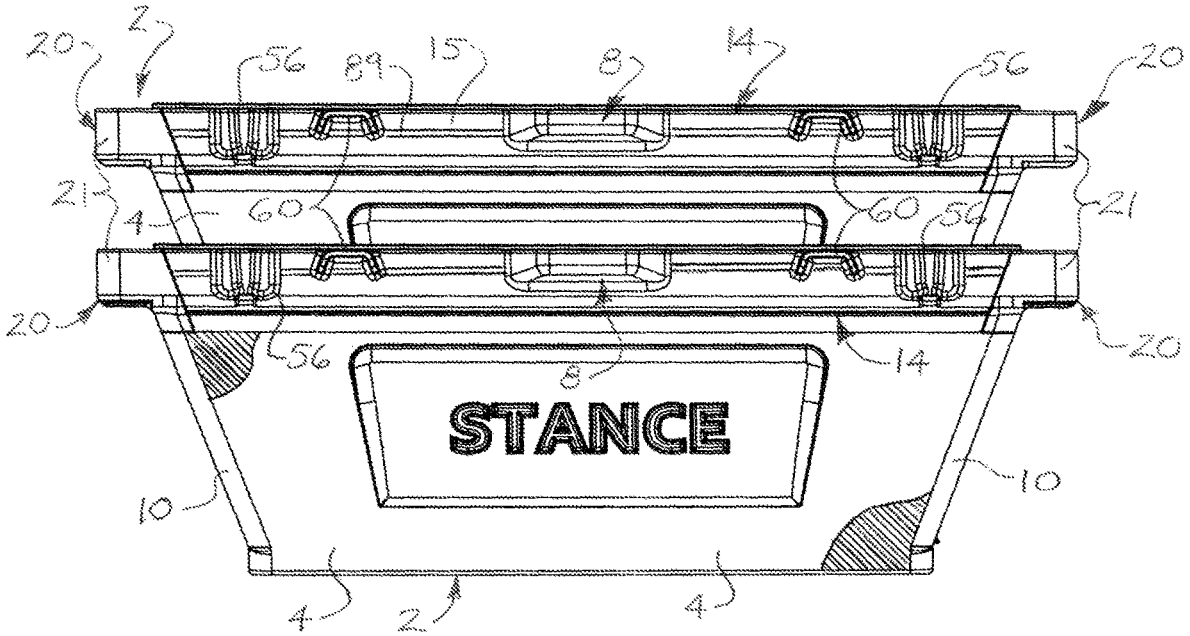
FIG. 15 is a front view of the nested nestable sunshade cooler enclosures illustrated in FIG. 14.

Enclosure corners 10 may join the enclosure front panel 4 and the enclosure rear panel 5 to the respective enclosure side panels 6 of the cooler enclosure 2. As particularly illustrated in FIGS. 2-5, in some embodiments, the enclosure front panel 4, the enclosure rear panel 5 and the enclosure side panels 6 may angle upwardly and outwardly from the enclosure bottom panel 3 to the enclosure rim 14 for purposes which will be hereinafter described. Accordingly, the enclosure front panel 4, the enclosure rear panel 5 and the enclosure side panels 6 may angle outwardly from the enclosure bottom panel 3 to the enclosure rim 14 to form a substantially trapezoid shape in cross-sectional view (FIGS. 16 and 17) and longitudinal sectional view (FIG. 24) of the cooler enclosure 2. Therefore, as illustrated in FIGS. 14 and 15, multiple stacked cooler enclosures 2 may be capable of substantially completely nesting inside one another for stowage purposes, as will be hereinafter described.

Figure 13:
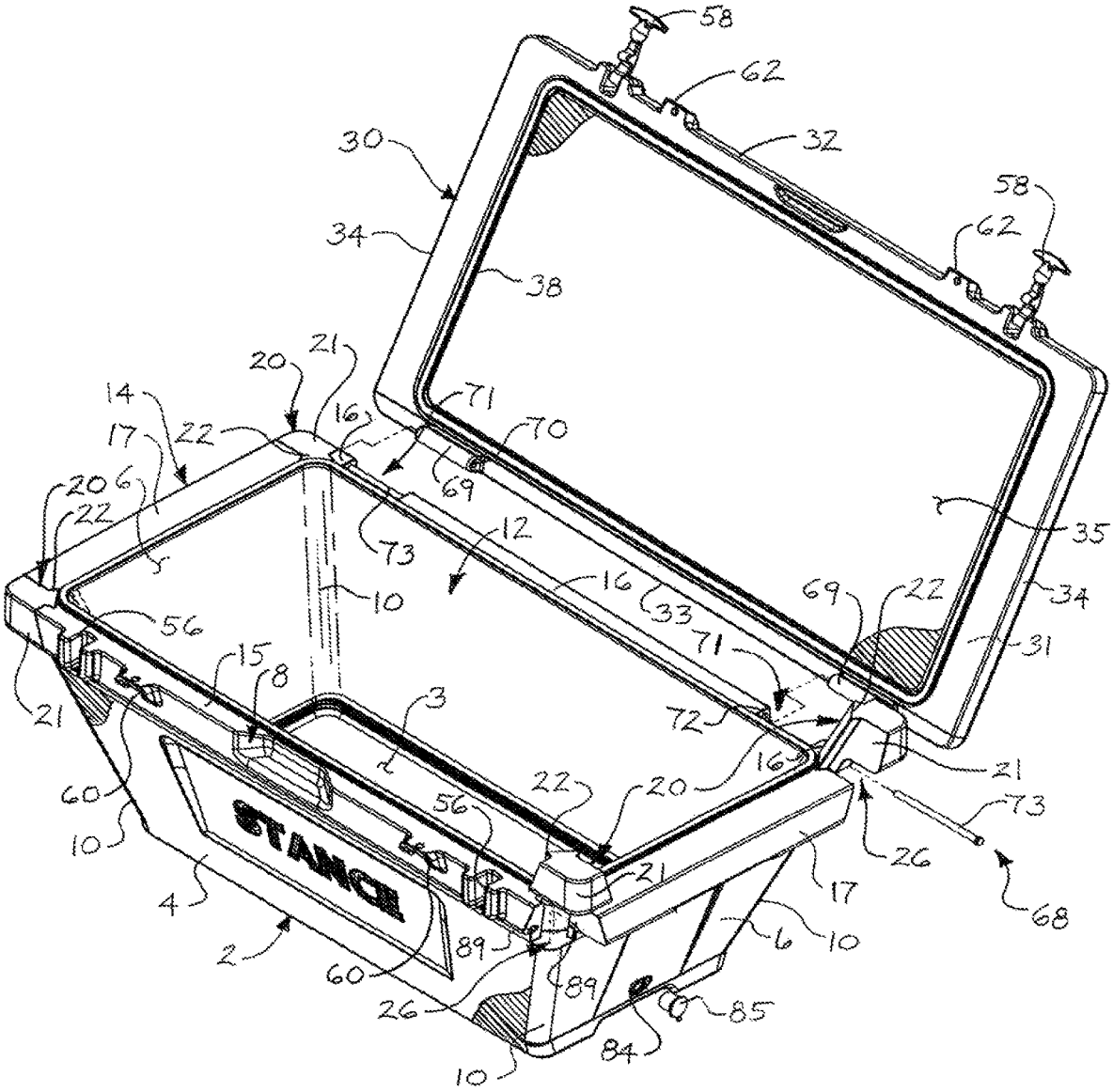
FIG. 13 is an exploded front perspective view of the illustrative nestable sunshade cooler, more particularly illustrating a typical hinge assembly for mounting the cooler lid on the cooler enclosure of the cooler.

As particularly illustrated in FIGS. 7, 8, 11 and 13, in some embodiments, corner insert cavities 26 may be provided at the respective enclosure corners 10 between the front rim segment 15 and the respective side rim segments 17 and between the rear rim segment 16 and the respective side rim segments 17 of the enclosure rim 14. A corner insert 20 may be selectively removably seated in the corner insert cavity 26. As illustrated in FIG. 13, each corner insert 20 may include an insert body 21. An elongated insert flange 22 may extend from the insert body 21. Accordingly, the insert flange 22 may be suitably sized and configured for insertion into a companion insert flange opening 27 (FIG. 7) in each corresponding enclosure corner 10 at the corner insert cavity 26. The insert body 21 of each corner insert 20 may be suitably sized and configured to securely seat on the corresponding enclosure corner 10 to close the corner insert cavity 26 as the insert flange 22 typically inserts into the insert flange opening 27. The insert bodies 21 of the respective corner inserts 20 may establish structural and aesthetic continuity between the front rim segment 15, the side rim segments 17 and the rear rim segment 16.

A cooler lid 30 may be closably mounted with respect to the cooler enclosure 2 for the purpose of selectively closing the enclosure interior 12 according to the knowledge of those skilled in the art. The cooler lid 30 may include a cooler lid panel 31. The cooler lid panel 31 may have a front lid edge 32, a rear lid edge 33 and side lid edges 34. The cooler lid panel 31 may further have an inner lid surface 35 and an outer lid surface 36. The inner lid surface 35 of the cooler lid panel 31 may face the enclosure interior 12 of the cooler enclosure 2 when the cooler lid 30 is in the closed position on the cooler enclosure 2. As illustrated in FIGS. 8 and 13, in some embodiments, a sealing gasket 38 may be provided on the inner lid surface 35 of the cooler lid panel 31. When the cooler lid 30 is in the closed position on the enclosure cooler 2, the sealing gasket 38 may engage the enclosure rim 14 to seal the enclosure interior 12.

The cooler enclosure 2 and the cooler lid 30 may be thermally insulated using any techniques and materials known by those skilled in the art and suitable for the purpose. For example and without limitation, in some embodiments, the cooler enclosure 2 and cooler lid 30 may be fabricated of a plastic shell with an thermally-insulating material sandwiched between inner and outer panels of the shell. The thermally-insulating material may include any type of material or combination of materials which are known by those skilled in the art as suitable for use in thermally-insulating coolers. In some embodiments, the thermally-insulating material may include extruded polystyrene foam (XPS) or STYROFOAM®. In some embodiments, the thermally-insulating material may include aerogel. Aerogel is a synthetic porous ultralight material derived from a gel, in which the liquid component of the gel has been replaced with a gas. The resulting solid has extremely low density and low thermal conductivity. Aerogels can be fabricated from a variety of chemical compounds and by extracting the liquid component of a gel through supercritical drying. This allows the liquid to be slowly dried off without causing the solid matrix in the gel to collapse from capillary action, as may occur with conventional evaporation. A non-limiting aerogel which is suitable for the purpose is available from ASPEN AEROGELS® (www.aerogel.com).

Figure 6:
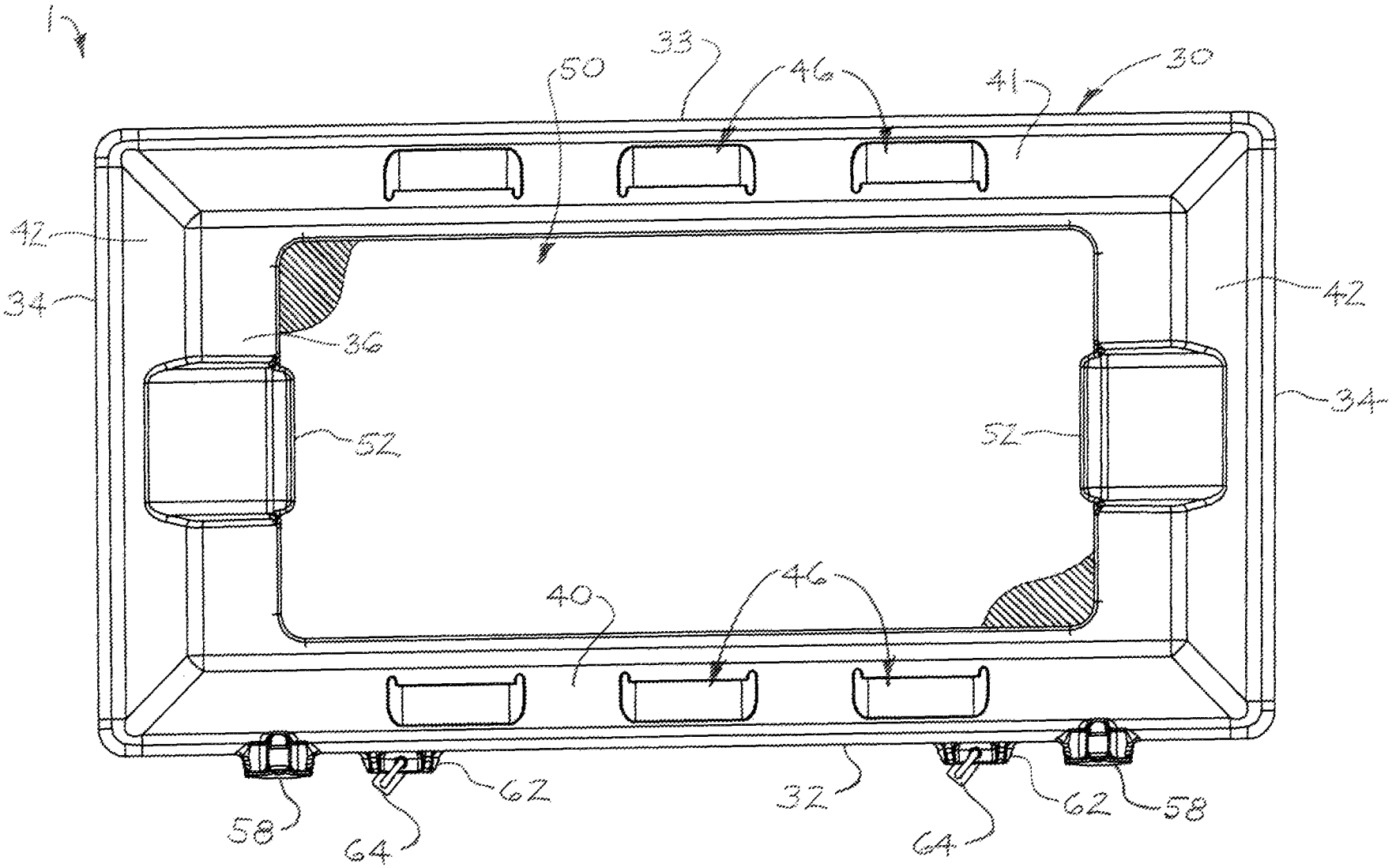
FIG. 6 is a typical top view of the illustrative closed nestable sunshade cooler.
Figure 7:
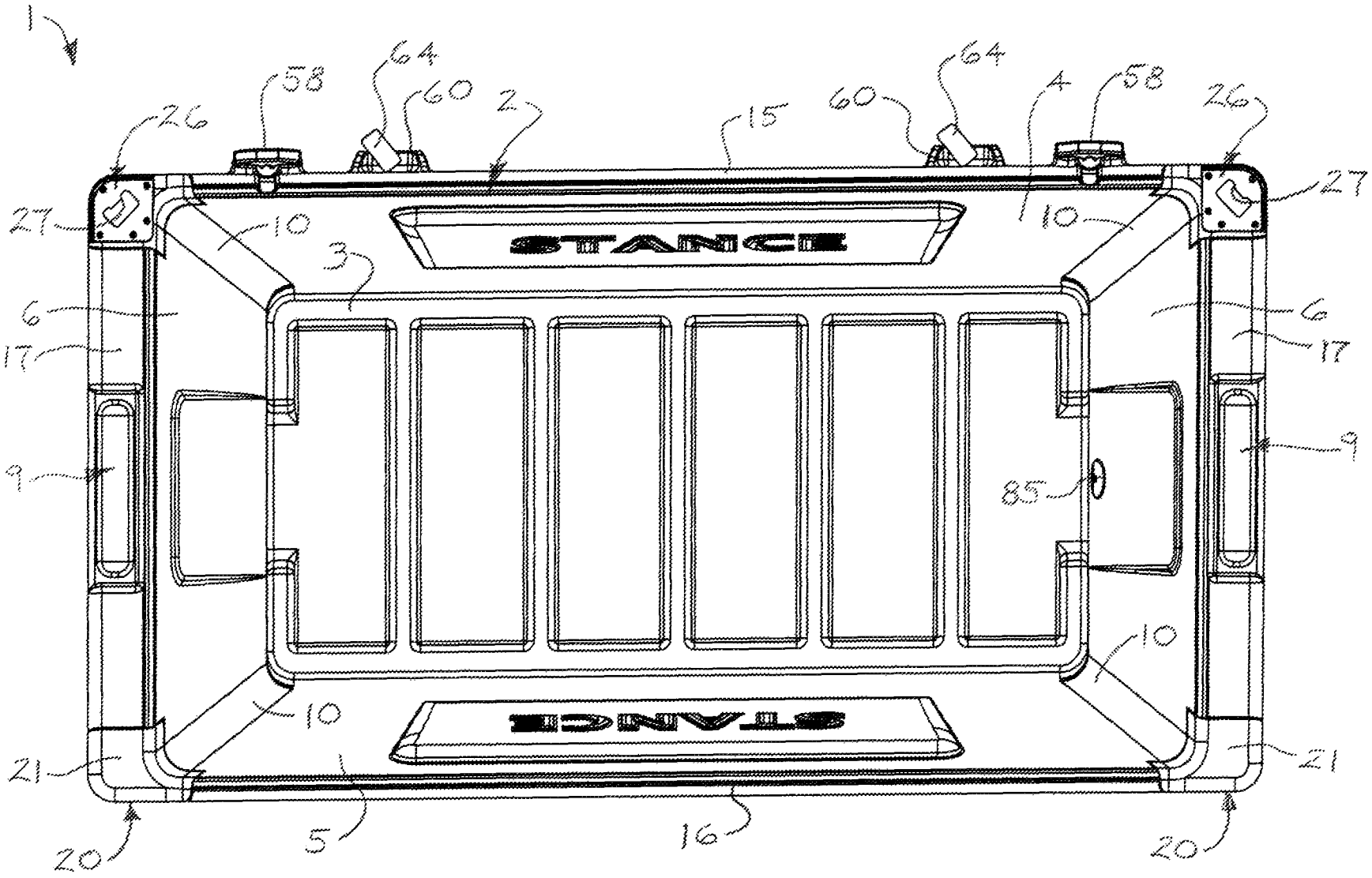
FIG. 7 is a typical bottom view of the illustrative nestable sunshade cooler.
Figure 12:
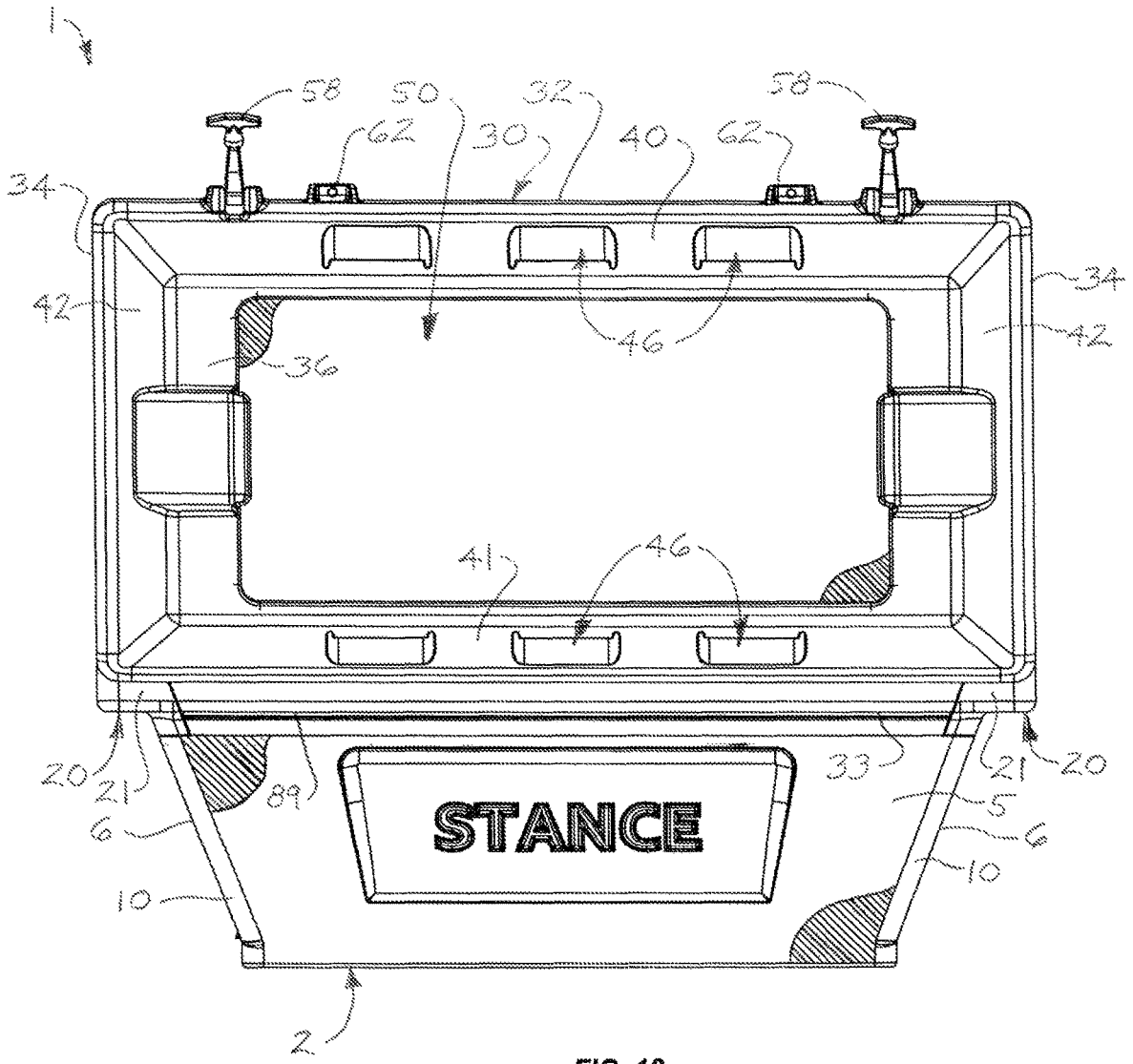
FIG. 12 is a rear view of the illustrative open nestable sunshade cooler.

Referring next to FIGS. 1, 6 and 12, in some embodiments, at least one lid cavity 50 may be provided in the outer lid surface 36 of the cooler lid panel 31 of the cooler lid 30. An elongated front lid ridge 40 may angle upwardly from the front lid edge 32 to the outer lid surface 36. Similarly, a beveled rear lid ridge 41 may angle upwardly from the rear lid edge 33 to the outer lid surface 36. A pair of beveled side lid ridges 42 may angle upwardly from the respective side lid edges 34 to the outer lid surface 36. The at least one lid cavity 50 may extend into the outer lid surface 36 between the front lid ridge 40, the rear lid ridge 41 and the side lid ridges 42.

The cooler lid 30 may be mounted on the cooler enclosure 2 according to the knowledge of those skilled in the art. Accordingly, as illustrated in FIG. 13, in some embodiments, a hinge assembly 68 may pivotally mount the cooler lid 30 on the enclosure cooler 2 for selective opening and closing of the cooler lid 30 on the cooler enclosure 2. In some embodiments, the hinge assembly 68 may include a pair of spaced-apart hinge pin sleeves 69 which may be provided on the inner lid surface 35 at or adjacent to the rear lid edge 33 of the cooler lid panel 31. A sleeve opening 70 may longitudinally traverse each hinge pin sleeve 69. A pair of spaced-apart sleeve slots 71 may be provided in the rear rim segment 16 of the enclosure rim 14. The sleeve slots 71 may positionally interface with the respective hinge pin sleeves 69 on the cooler lid 30. At least one pin opening 72 may extend into or longitudinally through the rear rim segment 16 of the enclosure rim 14 in communication with each sleeve slot 71. Accordingly, the hinge pin sleeves 69 on the cooler lid 30 may be inserted in the respective companion sleeve slots 71 in the rear rim segment 16 of the enclosure rim 14 with the sleeve openings 70 in the respective hinge pin sleeves 69 registering with the pin opening or openings 72 in the rear rim segment 16 of the enclosure rim 14. At least one hinge pin 73 may be inserted through the sleeve openings 70 in the respective hinge pin sleeves 69 and into the registering pin opening or openings 72 in the rear rim segment 16 to pivotally mount the cooler lid 30 on the cooler enclosure 2. Insertion of the hinge pin or pins 73 through the respective sleeve openings 70 and into the registering pin opening or openings 72 may be facilitated first by removal of the corner inserts 20 from the respective corner insert cavities 26 between the rear rim segment 16 and the respective side rim segments 17 of the enclosure rim 14, as illustrated in FIG. 13. This action may expose the pin openings 72 for insertion of the hinge pin or pins 73. After deployment of the hinge pin or pins 73, the corner inserts 20 may be reinserted into the respective corner insert cavities 26. Accordingly, it will be appreciated by those skilled in the art that the corner inserts 20, when deployed in the respective corner insert cavities 26 at the respective ends of the side rim segment 16, may conceal and block or prevent access to the hinge pin or pins 73 and unauthorized disassembly of the hinge assembly 68 and removal of the cooler lid 30 from the cooler enclosure 2.

The cooler enclosure 2 and the cooler lid 30 of the nesting cooler 1 may be fabricated of plastic, composite materials, closed-cell extruded polystyrene foam (STYROFOAM®) and/or other thermally-insulative materials known by those skilled in the art. In some embodiments, the enclosure bottom panel 3, enclosure front panel 4, enclosure rear panel 5 and enclosure side panels 6 of the cooler enclosure 2 and the cooler lid panel 31 of the cooler lid 30 may each be fabricated of a plastic or composite material shell. A thermally-insulative filling material such as polystyrene foam and/or aerogel, for example and without limitation, may be provided in the shell. Aerogel is a synthetic porous ultralight material which is derived from a gel, in which the liquid component of the gel has been replaced with a gas. The result is a solid material with extremely low density and low thermal conductivity. The cooler enclosure 2, cooler lid 30 and other components of the nesting cooler 1 may be fabricated using molding and/or other fabrication techniques known by those skilled in the art.

As illustrated in FIGS. 1-3 and 6 of the drawings, at least one lid handle slot 46 may be provided in each of the front lid ridge 40 and the rear lid ridge 41 on the cooler lid 30. Preparatory to nesting of the cooler enclosures 2 of multiple nesting coolers 1, as illustrated in FIGS. 14 and 15 and will be hereinafter described, the lid handle slots 46 may facilitate lifting of the cooler lid 30 from the cooler enclosure 2 after disassembly of the hinge assembly 68 (FIG. 13). At least one retainer flange 52 may be provided on the outer lid surface 36 adjacent to at least one of the front lid ridge 40, the rear lid ridge 41 and at least one of the side lid ridges 42. The retainer flange 52 may be flexible and may protrude over the lid cavity 50 for purposes which will be hereinafter described.

Figure 2:
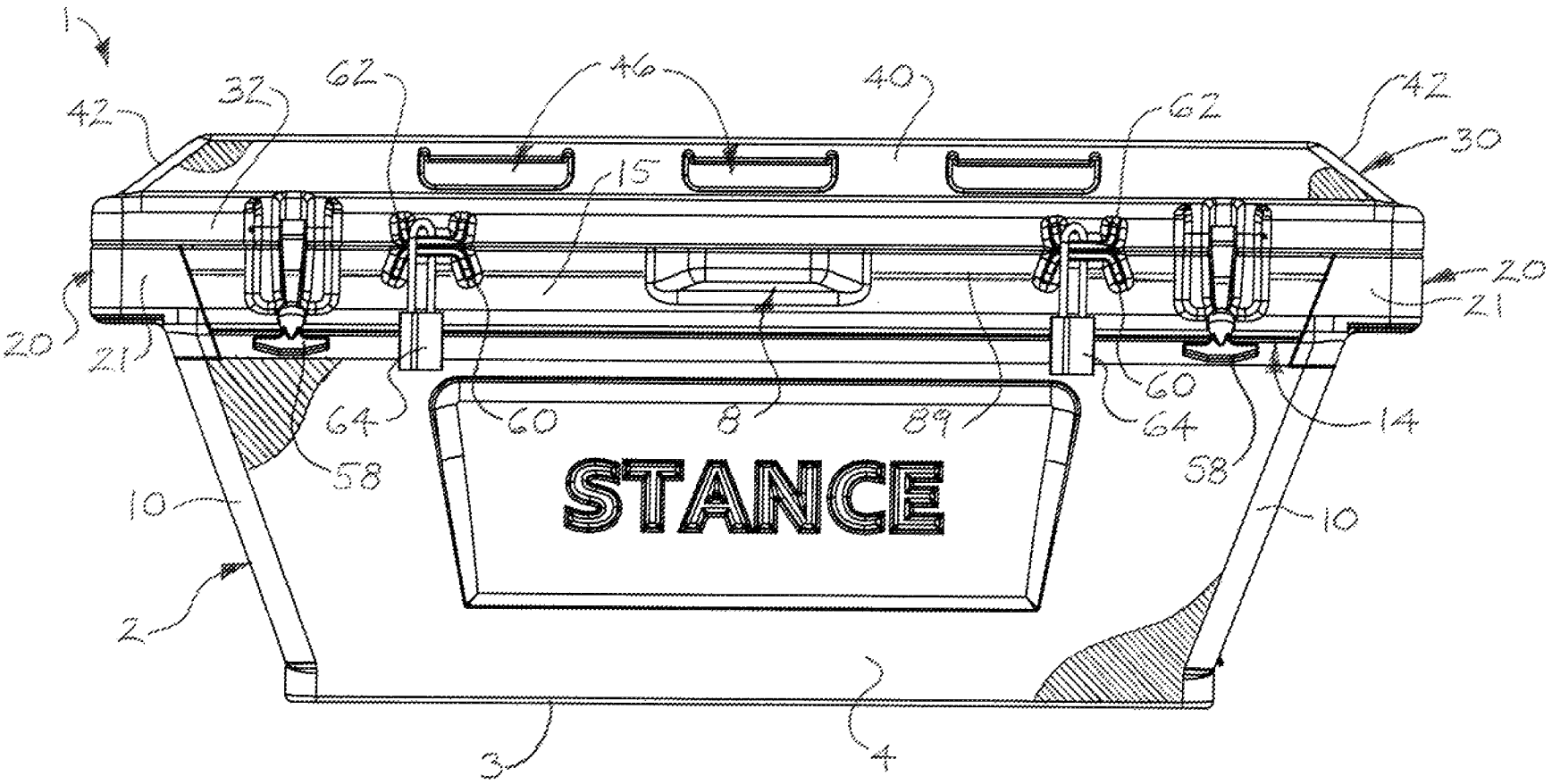
FIG. 2 is a typical front view of the illustrative closed nestable sunshade cooler.

As illustrated in FIGS. 1, 2 and 8, at least one lid access slot 8 may be provided in the front rim segment 15 of the enclosure rim 14 beneath the front lid edge 32 of the cooler lid 30. The lid access slot 8 may facilitate digital or manual access for lifting and pivoting of the cooler lid 30 from the closed position (FIGS. 1-7) to the open position (FIG. 8) on the cooler enclosure 2. As illustrated in FIGS. 1, 4 and 5, in some embodiments, at least one pair of side handle slots 9 may be provided in the respective side rim segments 17 of the enclosure rim 14. The side handle slots 9 may facilitate manual access for lifting and carrying of the nesting cooler 1.

Figure 9:
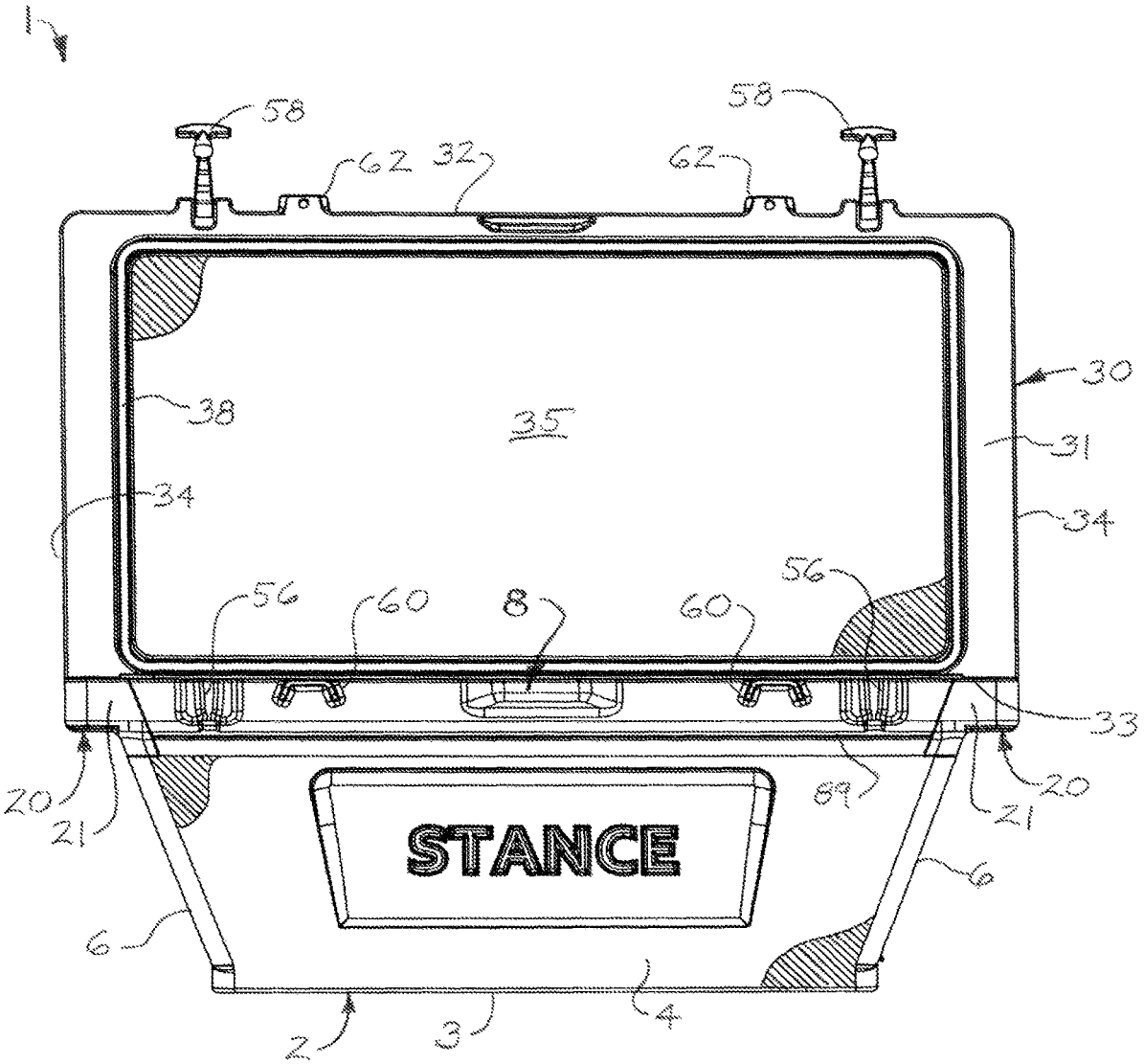
FIG. 9 is a front view of the illustrative open nestable sunshade cooler.
Figure 10:
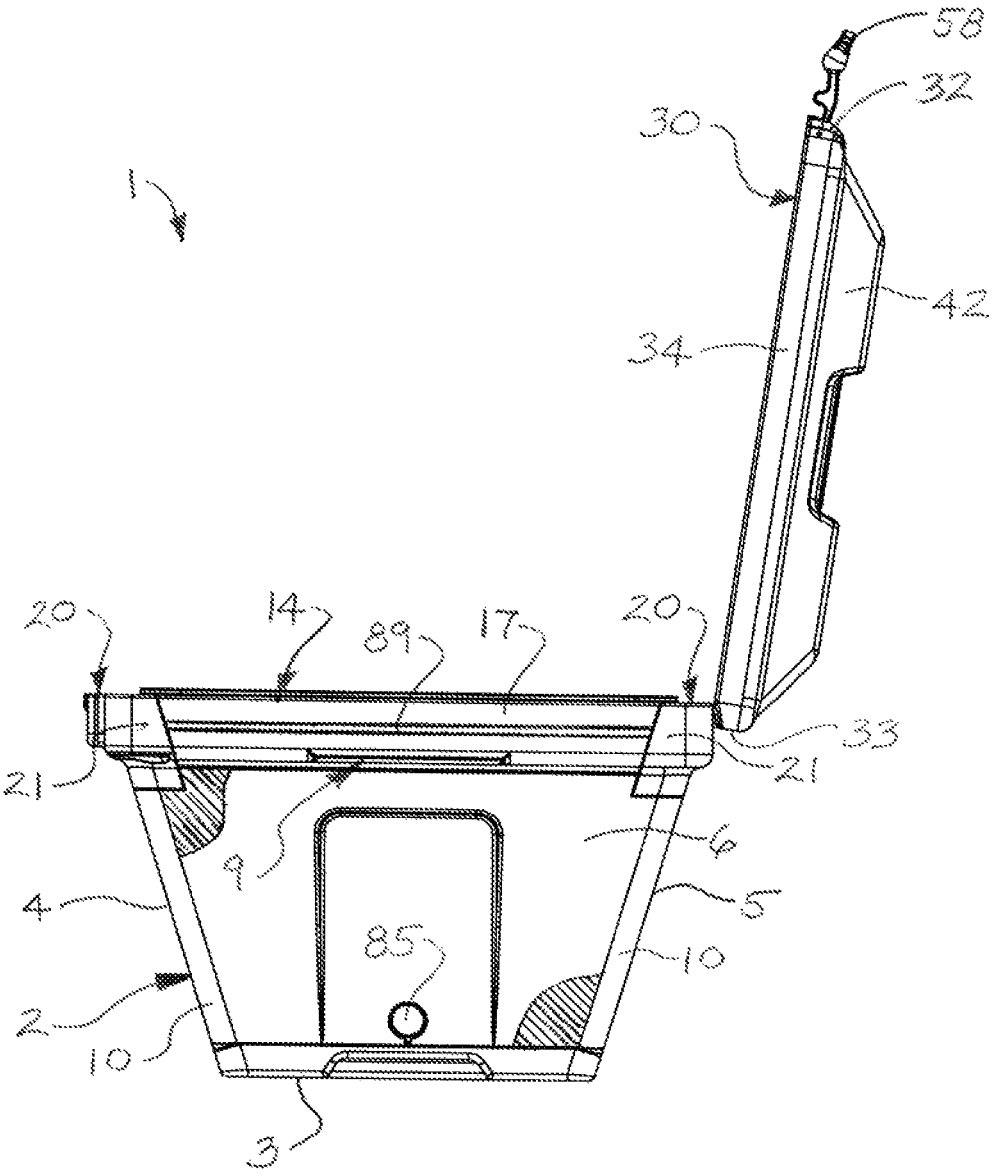
FIG. 10 is a left side view of the illustrative open nestable sunshade cooler.
Figure 11:
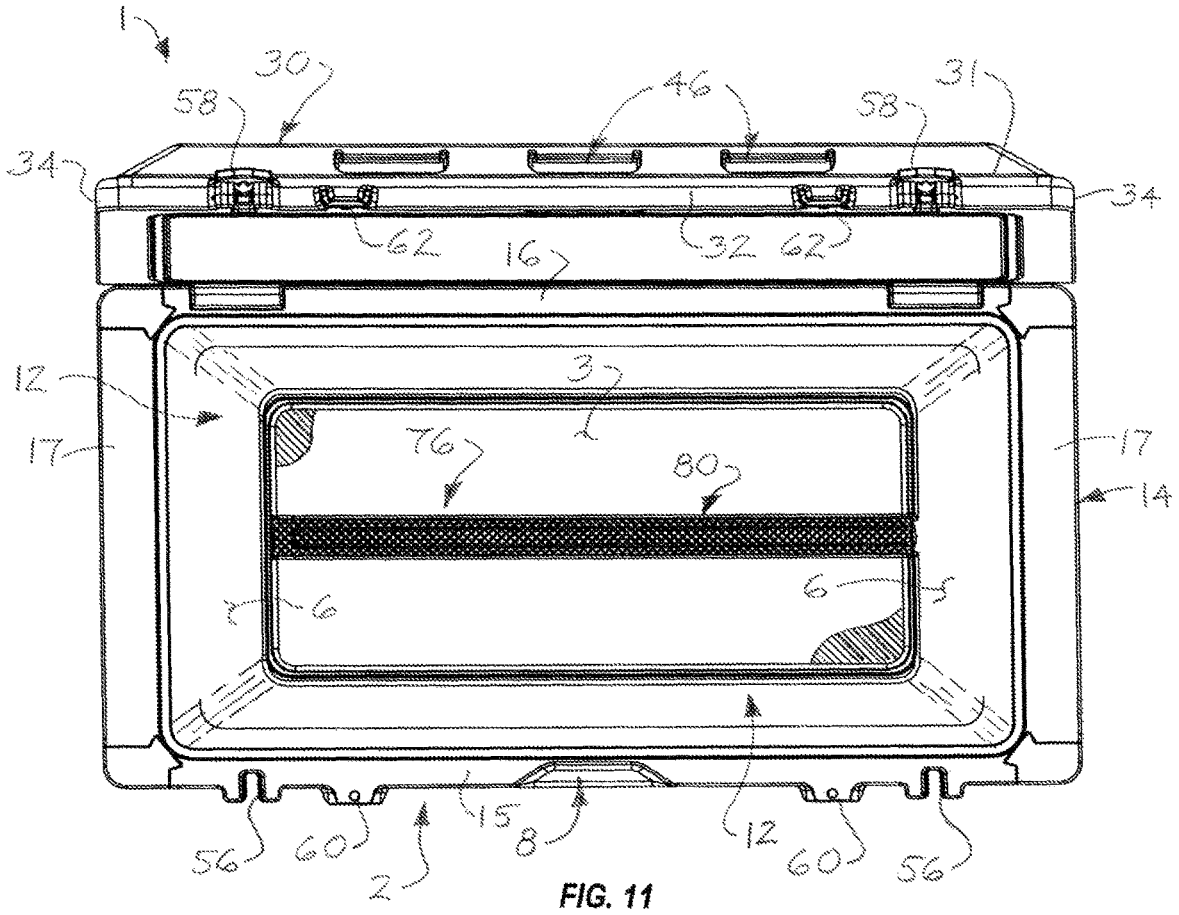
FIG. 11 is a top view of the illustrative open nestable sunshade cooler, more particularly illustrating a typical drain assembly deployed in place in the enclosure interior of the cooler enclosure.

As illustrated in FIGS. 8 and 9, in some embodiments, at least one lock handle slot 56 may be provided in the front rim segment 15 of the enclosure rim 14. At least one lid lock handle 58 may be provided on the front lid edge 32 of the cooler lid panel 31 of the cooler lid 30. The lid lock handle 58 may be pivotally mounted on the cooler lid panel 31 according to the knowledge of those skilled in the art. Therefore, when the cooler lid 30 is in the closed position on the cooler enclosure 2, the lid lock handle 58 may be pivoted with respect to the cooler lid 30 and inserted into the lock handle slot 56 to secure the cooler lid 30 in the closed position on the cooler enclosure 2.

In some embodiments, at least one enclosure lock flange 60 may be provided on the front rim segment 15 of the enclosure rim 14. At least one companion lid lock flange 62 may be provided on the front lid edge 32 of the cooler lid panel 31 of the cooler lid 30. As illustrated in FIG. 1, a padlock 64 may be inserted and secured through registering lock openings (not illustrated) in the enclosure lock flange 60 and the lid lock flange 62 to lock the cooler lid 30 in the closed position on the cooler enclosure 2.

Figure 16:
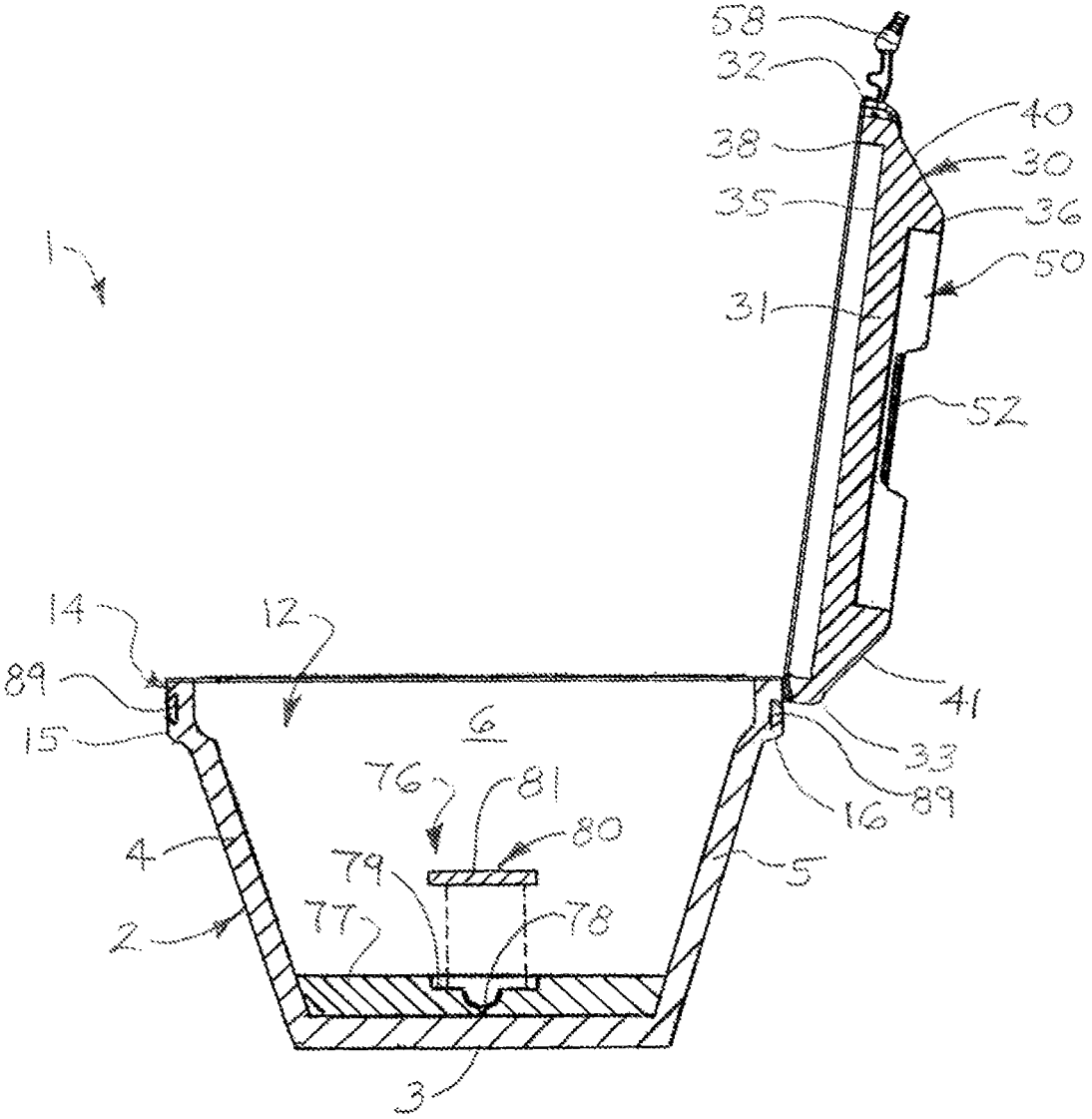
FIG. 16 is a cross-sectional view, taken along section lines 16-16 in FIG. 8, of the illustrative nestable sunshade cooler with the cooler lid shown in an open position on the cooler enclosure and the drain assembly shown in exploded view.
Figure 17:
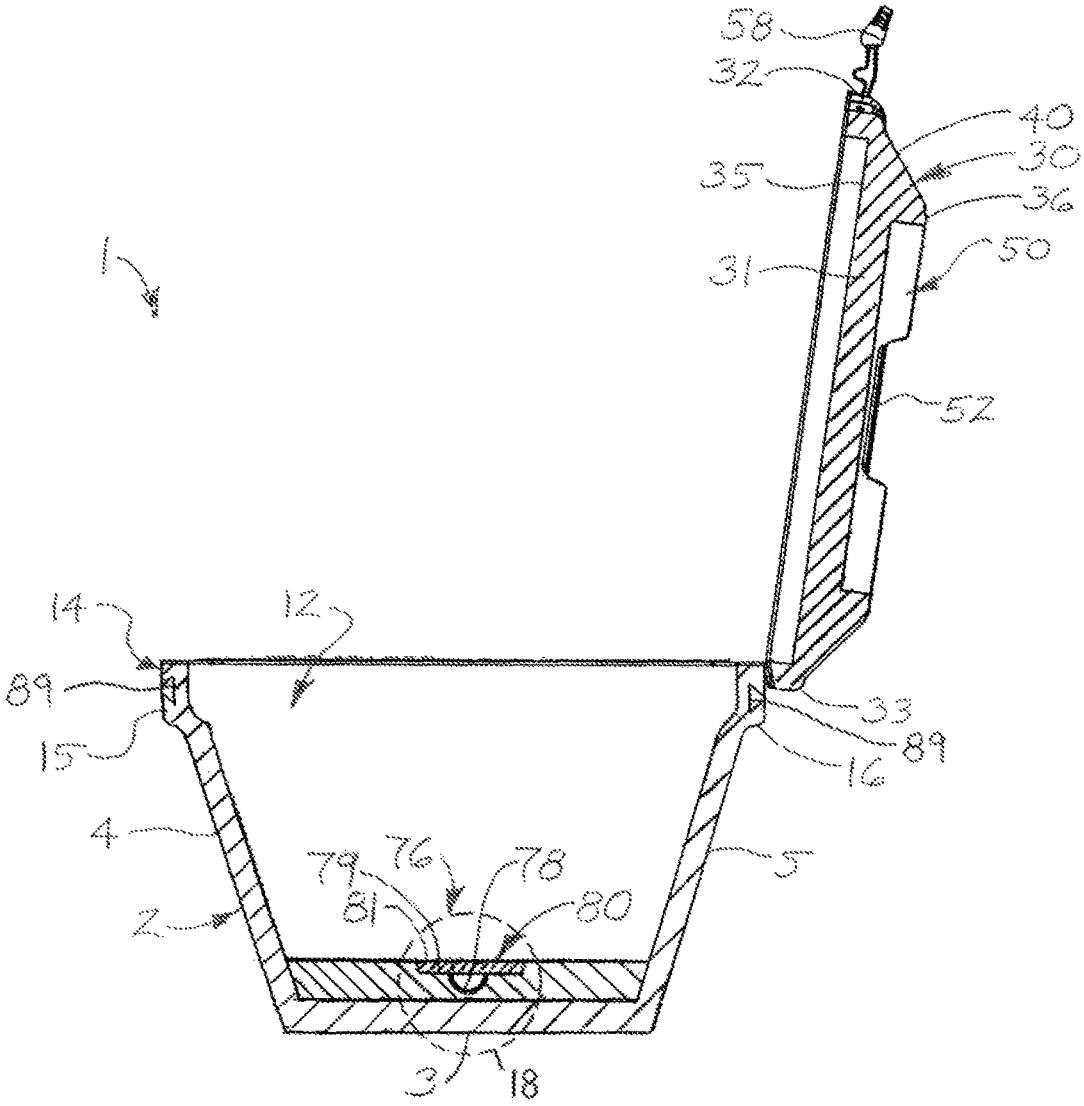
FIG. 17 is a cross-sectional view of the illustrative nestable sunshade cooler, also taken along section lines 16-16 in FIG. 8, with the drain assembly shown in an assembled configuration.
Figure 18:
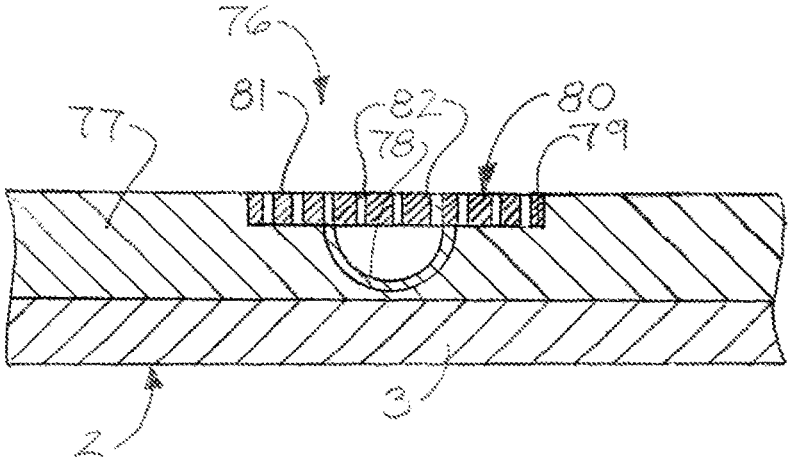
FIG. 18 is an enlarged sectional view of the assembled drain assembly, taken along section line 18 in FIG. 17.
Figure 24:
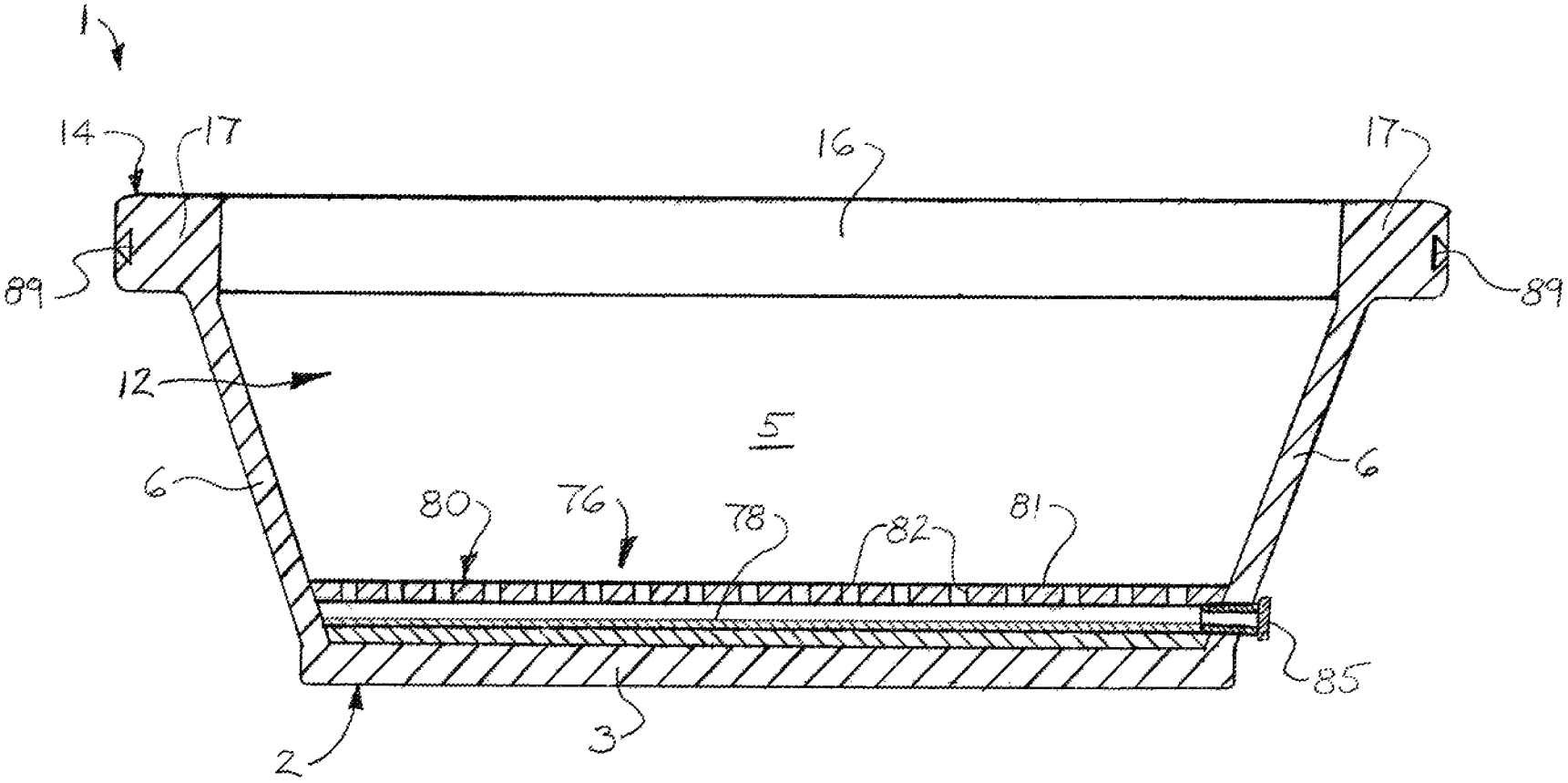
FIG. 24 is a longitudinal sectional view of the cooler enclosure of the illustrative nestable sunshade cooler, taken along section lines 24-24 in FIG. 8, with the cooler lid not illustrated in FIG. 24.

As illustrated in FIGS. 11 and 16-18 of the drawings, in some embodiments, at least one drain assembly 76 may be provided in the enclosure interior 12 of the cooler enclosure 2. As illustrated in FIGS. 16-18, in some embodiments, the drain assembly 76 may include a drain insert 77. The drain insert 77 may be suitably sized and configured to fit on the enclosure bottom panel 3 inside the enclosure interior 12. An elongated drain panel seat 79 may be provided in the drain insert 77. As illustrated in FIG. 24, in some embodiments, the drain panel seat 79 may be substantially coextensive with the drain insert 77 and may extend substantially from one enclosure side panel 6 to the other enclosure side panel 6 of the cooler enclosure 2. A drain trough 78 may be provided in the drain insert 77. The drain trough 78 may be substantially coextensive with the drain panel seat 79. In alternative embodiments, the drain insert 77 may be omitted and the drain trough 78 and the drain panel seat 79 may be provided in the enclosure bottom panel 3 of the cooler enclosure 2.

An elongated drain panel 80 may be removably seated in the drain panel seat 79 in overlying relationship to the drain trough 78. As illustrated in FIG. 18, the drain panel 80 may include an elongated, rectangular drain panel body 81. Multiple drain panel openings 82 may extend through the drain panel body 81. Accordingly, the drain panel openings 82 may establish fluid communication between the enclosure interior 12 of the cooler enclosure 2 and the underlying drain trough 78.

As illustrated in FIG. 13, at least one drain opening 84 may extend through at least one of the enclosure side panels 6 of the cooler enclosure 2. The drain opening 84 may communicate with the drain trough 78 (FIGS. 17 and 18) in the enclosure bottom panel 3 or drain insert 77. A drain cap 85 may detachably or reversibly seal the drain opening 84.

Figure 3:
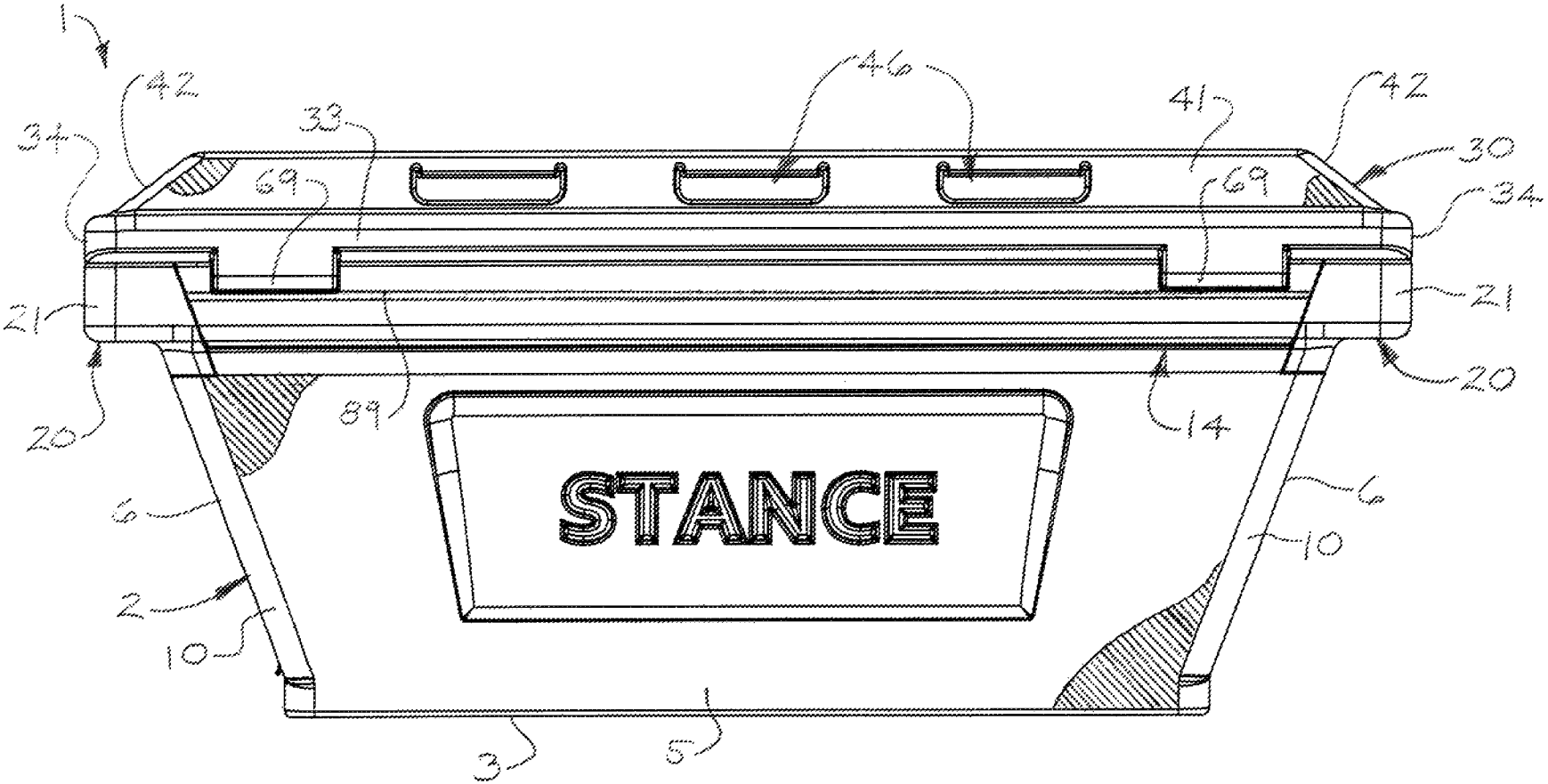
FIG. 3 is a typical rear view of the illustrative closed nestable sunshade cooler.
Figure 4:
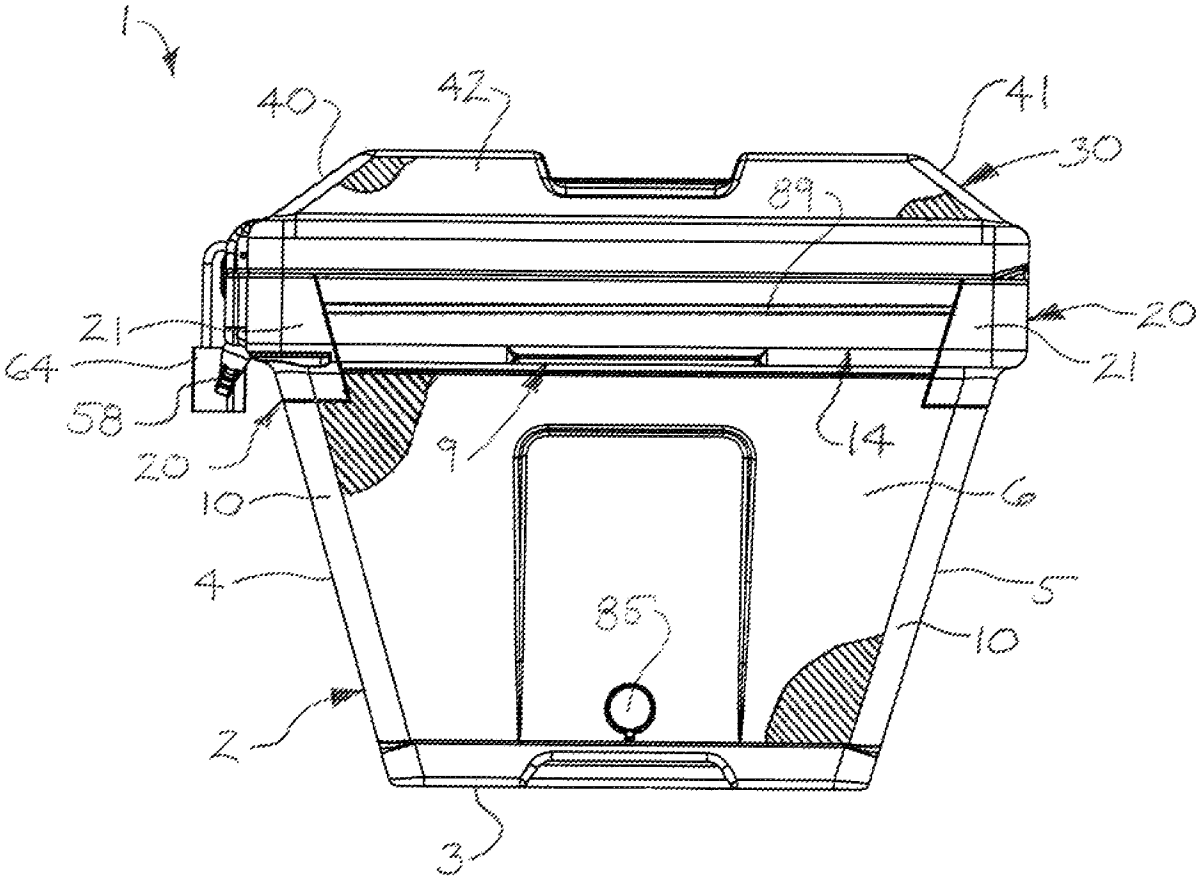
FIG. 4 is a typical left-side view of the illustrative closed nestable sunshade cooler.
Figure 5:
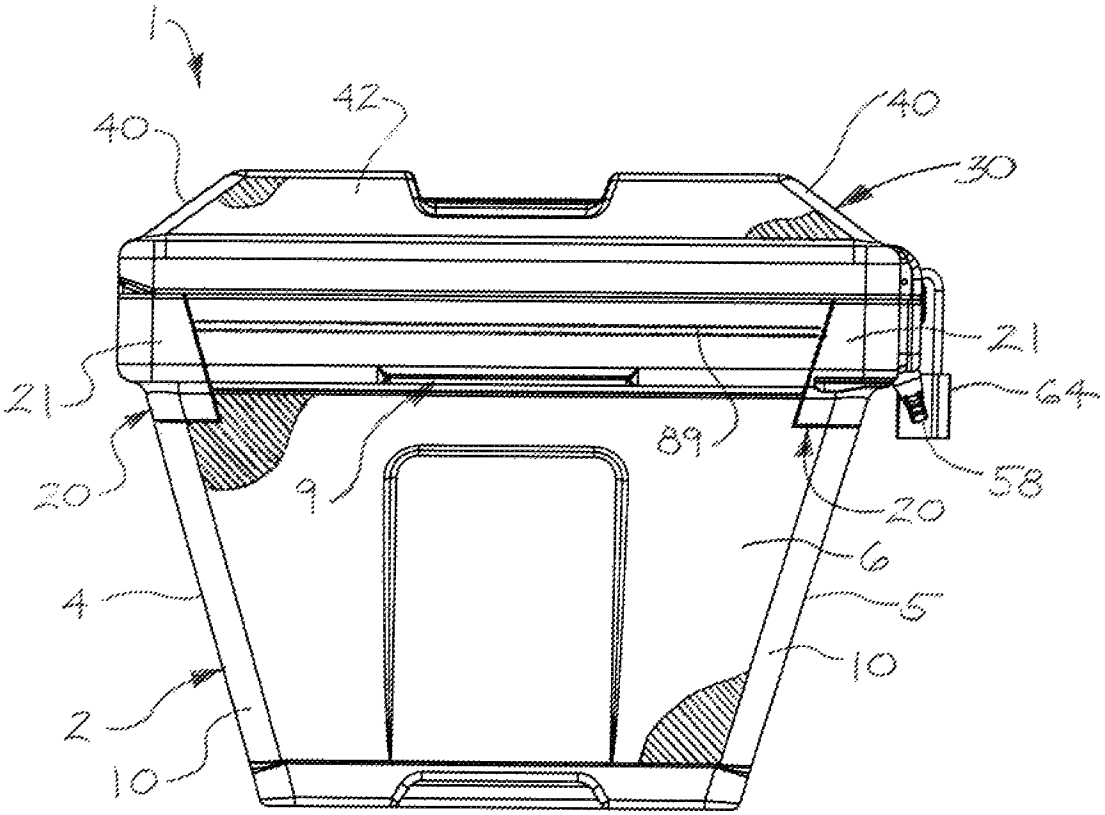
FIG. 5 is a typical right-side view of the illustrative closed nestable sunshade cooler.
Figure 19:
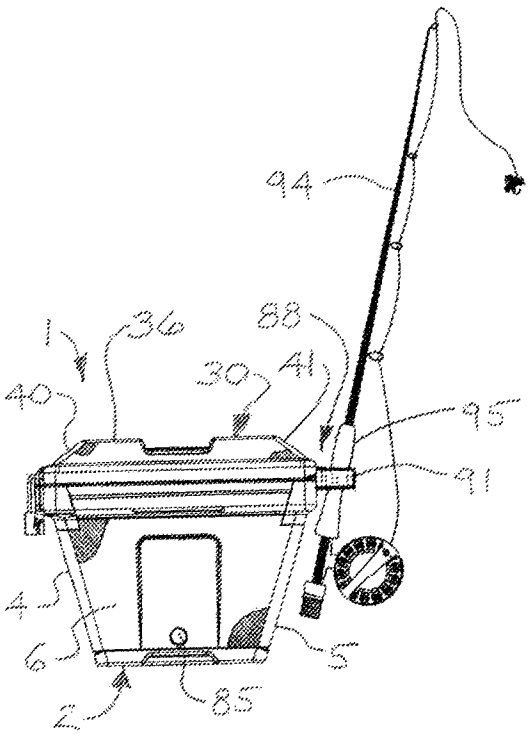
FIG. 19 is a left side view of the illustrative nestable sunshade cooler with a typical accessory mount assembly provided on the nestable sunshade cooler and a fishing rod mounted in the accessory mount assembly in exemplary application of the accessory mount assembly.

Referring next to FIGS. 2-5, 13 and 19-21 of the drawings, in some embodiments, an accessory mount assembly 88 (FIGS. 19-21) may be provided on the cooler enclosure 2 to facilitate holding an accessory such as a fishing rod 94, as illustrated in FIG. 19 and will be hereinafter described. The accessory mount assembly 88 may include at least one elongated flange slot 89 which may be provided in the enclosure rim 14 of the cooler enclosure 2. In some embodiments, at least one flange slot 89 may be provided in at least one of the front rim segment IS, the rear rim segment 16 and the side rim segments 17 of the enclosure rim 14. As illustrated in FIGS. 3-5, in some embodiments, a flange slot 89 may be provided in each of the front rim segment 15, the rear rim segment 16 and the side rim segments 17 of the enclosure rim 14. The corner insert cavities 26 (FIGS. 7 and 13) may communicate with the respective open ends of the flange slots 89 in the front rim segment 15, the rear rim segment 16 and the side rim segments 17. Accordingly, the corner inserts 20, when seated in the respective corner insert cavities 26 (FIGS. 7 and 13), may interrupt the continuity of the flange slots 89 for purposes which will be hereinafter described.

Figure 20:
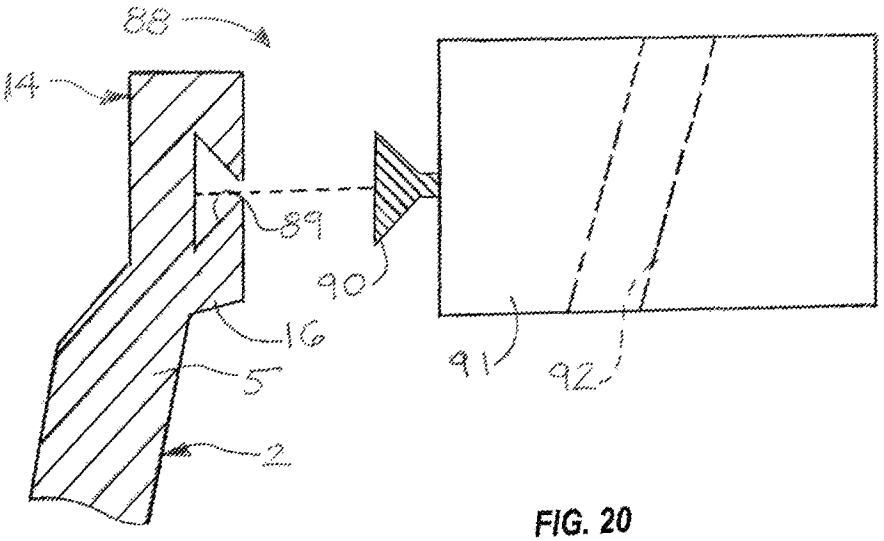
FIG. 20 is an enlarged sectional view of the enclosure rim on the cooler enclosure, more particularly illustrating a flange slot of a typical accessory mount assembly provided in the enclosure rim of the cooler enclosure, an accessory holder having an accessory opening and an accessory holder mount flange provided on the accessory holder, more particularly illustrating typical engagement of the accessory holder mount flange with the flange slot in mounting of the accessory holder on the cooler enclosure.
Figure 21:
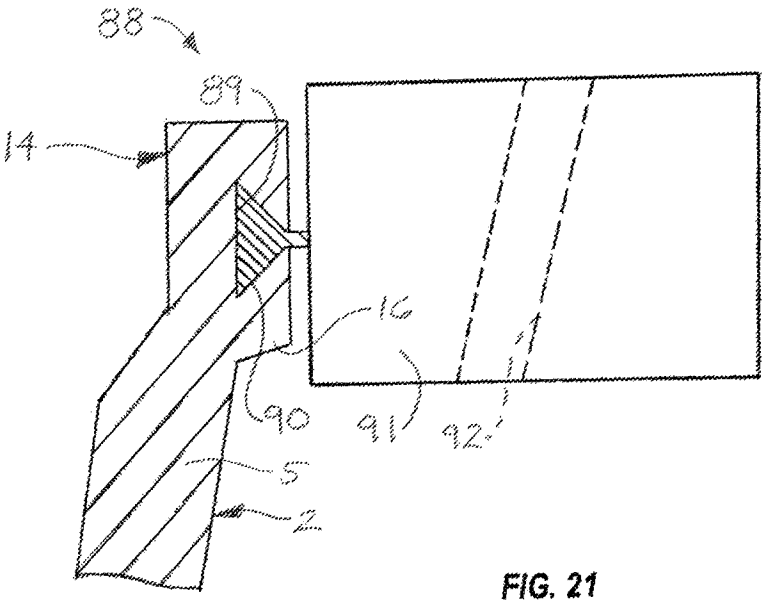
FIG. 21 is an enlarged cross-sectional view of the enclosure rim on the cooler enclosure, with the accessory holder mount flange on the accessory holder engaging the companion flange slot in the enclosure rim.

As illustrated in FIGS. 19-21, the accessory mount assembly 88 may include at least one accessory holder 91. At least one accessory holder mount flange 90 may extend from the accessory holder 91. The accessory holder mount flange 90 may be suitably sized and configured to insert into the flange slot 89 in the enclosure rim 14. In some embodiments, the flange slot 89 and the accessory holder mount flange 90 may include a dovetail groove and a companion dovetail flange, respectively, as illustrated. The accessory holder 91 may be suitably adapted or configured to support at least one accessory such as the fishing rod 94, a cup containing a beverage (not illustrated) or the like. Accordingly, in some embodiments, at least one accessory opening 92 (illustrated in phantom in FIGS. 20 and 21) may be provided in or extend through the accessory holder 91. The accessory opening 92 may be suitably sized and configured to accommodate the at least one accessory such as the fishing rod handle 95 (FIG. 19) or other element of the fishing rod 94 or other accessory. Thus, when the accessory holder mount flange 90 is inserted in the companion flange slot 89, the accessory holder 91 may hold and support the fishing rod 94 in an accessible position or orientation along the length of the selected front rim segment 15, rear rim segment 16 or side rim segment 17 of the enclosure rim 14. It will be appreciated by those skilled in the art that the accessory holder 91 may be suitably adapted to contain, support or facilitate attachment of any of a variety of accessories to the cooler enclosure 2. Such accessories may include but are not limited to game bags, shell belts, gun saddle bags, wood or plastic cutting boards and D-rings.

Each flange slot 89 may be accessed to facilitate insertion of the accessory holder mount flange 90 into the flange slot 89 typically by initial removal of one of the corner inserts 20 from the corresponding corner insert cavity 26. This step may expose an open slot end of the flange slot 89 at the now vacant corner insert cavity 26 to facilitate insertion of the accessory holder mount flange 90 into the flange slot 89 through the open slot end. The corner insert 20 may subsequently be inserted back into the corner insert cavity 26 to conceal the flange slot 89. The accessory holder mount flange 90 may be slid within the flange slot 89 to position the accessory holder 91 at any desired position along the length of the corresponding selected front rim segment 15, the rear rim segment 16 or side rim segments 17 of the enclosure rim 14. The accessory holder 91 may be selectively removed from the cooler enclosure 2 by again removing the corner insert 20 from the corresponding corner insert cavity 26, sliding the accessory holder mount flange 90 along the flange slot 89 and from the now exposed slot end of the flange slot 89, and then replacing the corner insert 20 in the corner insert cavity 26.

Figure 26:
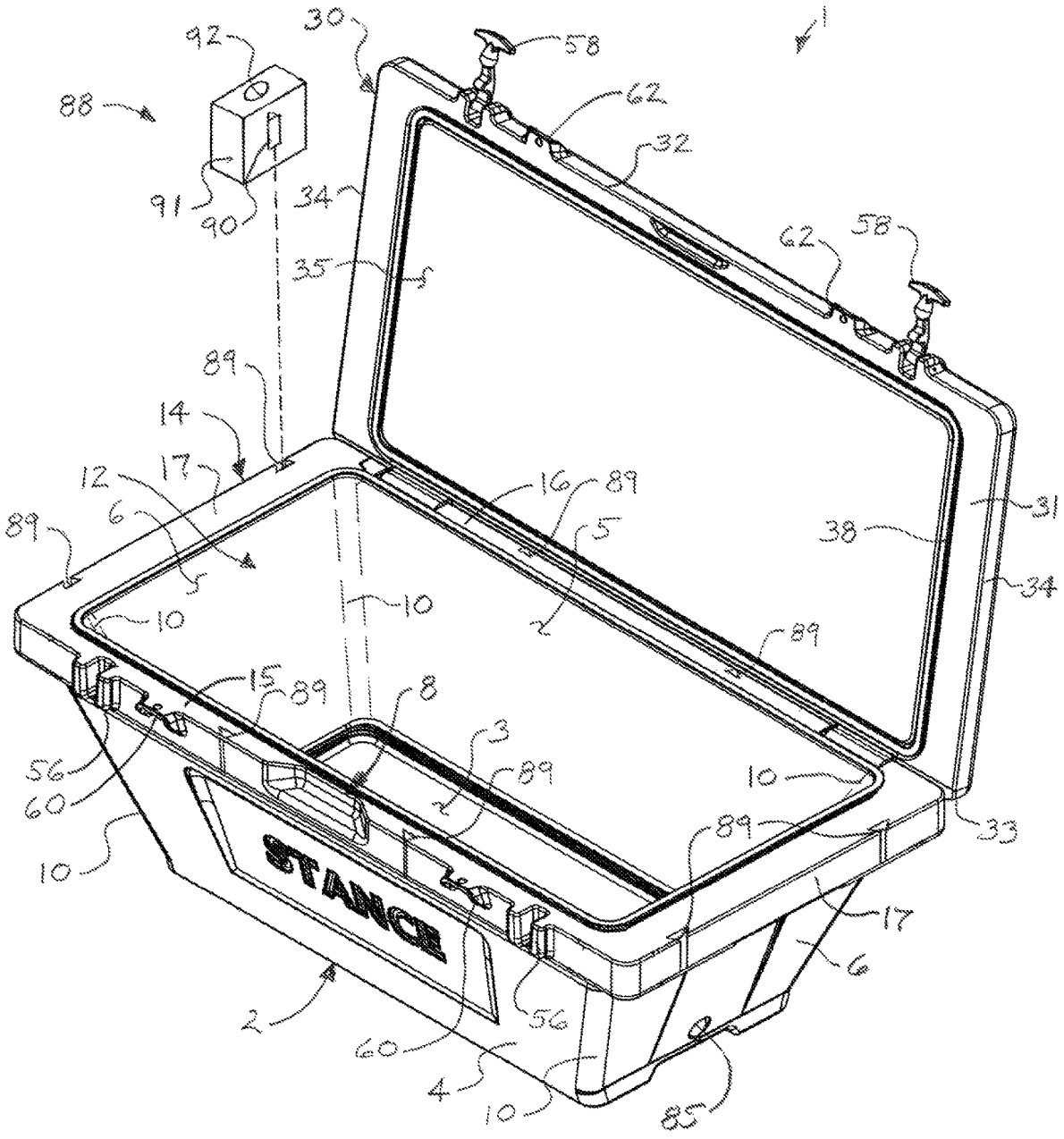
FIG. 26 is a front exploded perspective view of an illustrative nestable sunshade cooler in the open position, more particularly illustrating typical engagement of an accessory holder mount flange on an accessory holder of an accessory mount assembly with a vertical flange slot in the side rim segment of the enclosure rim.
Figure 27:
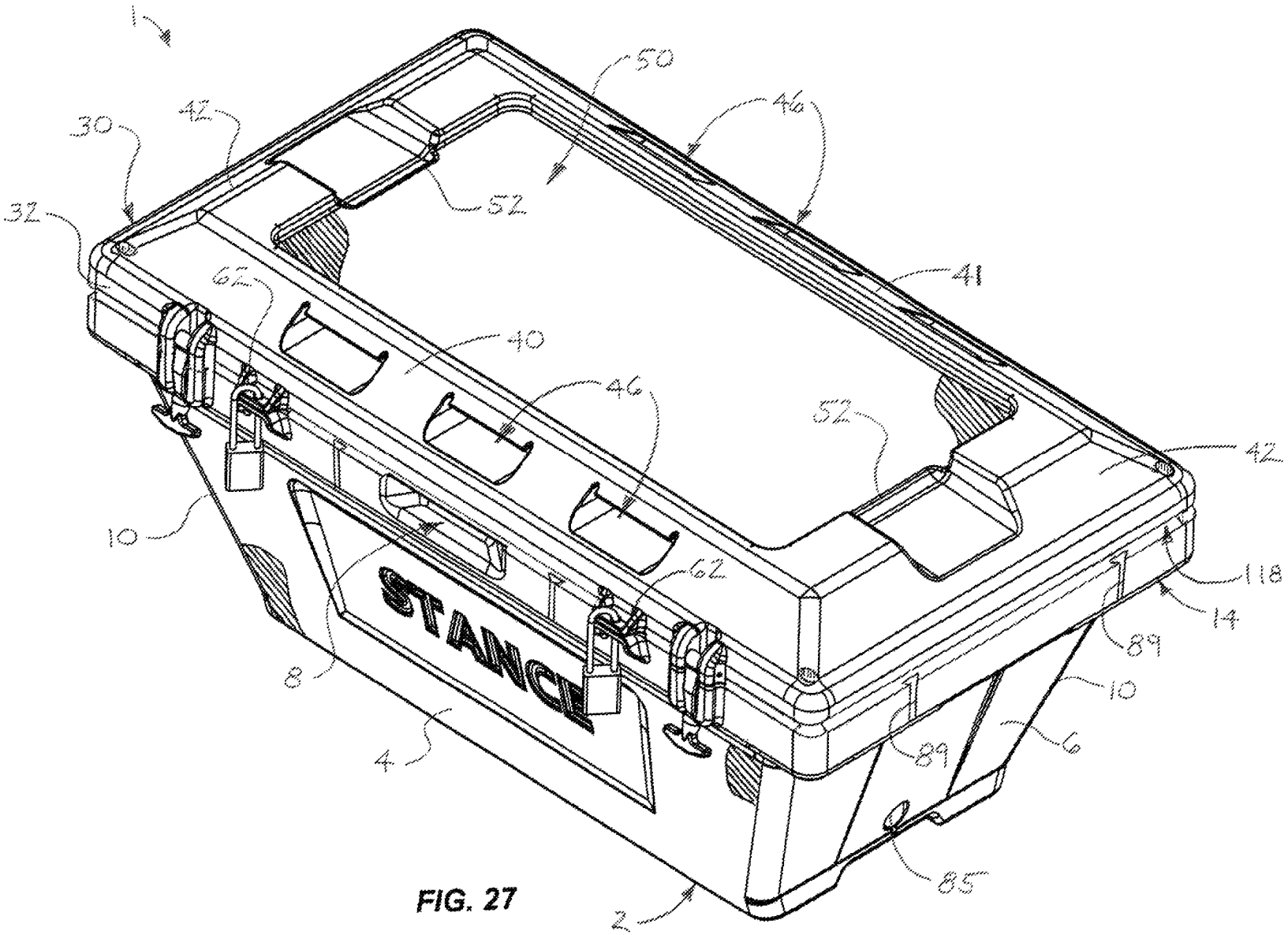
FIG. 27 is a front perspective view of an illustrative nestable sunshade cooler in the closed position, more particularly illustrating an alternative configuration of the accessory mount assembly.
Figure 28:
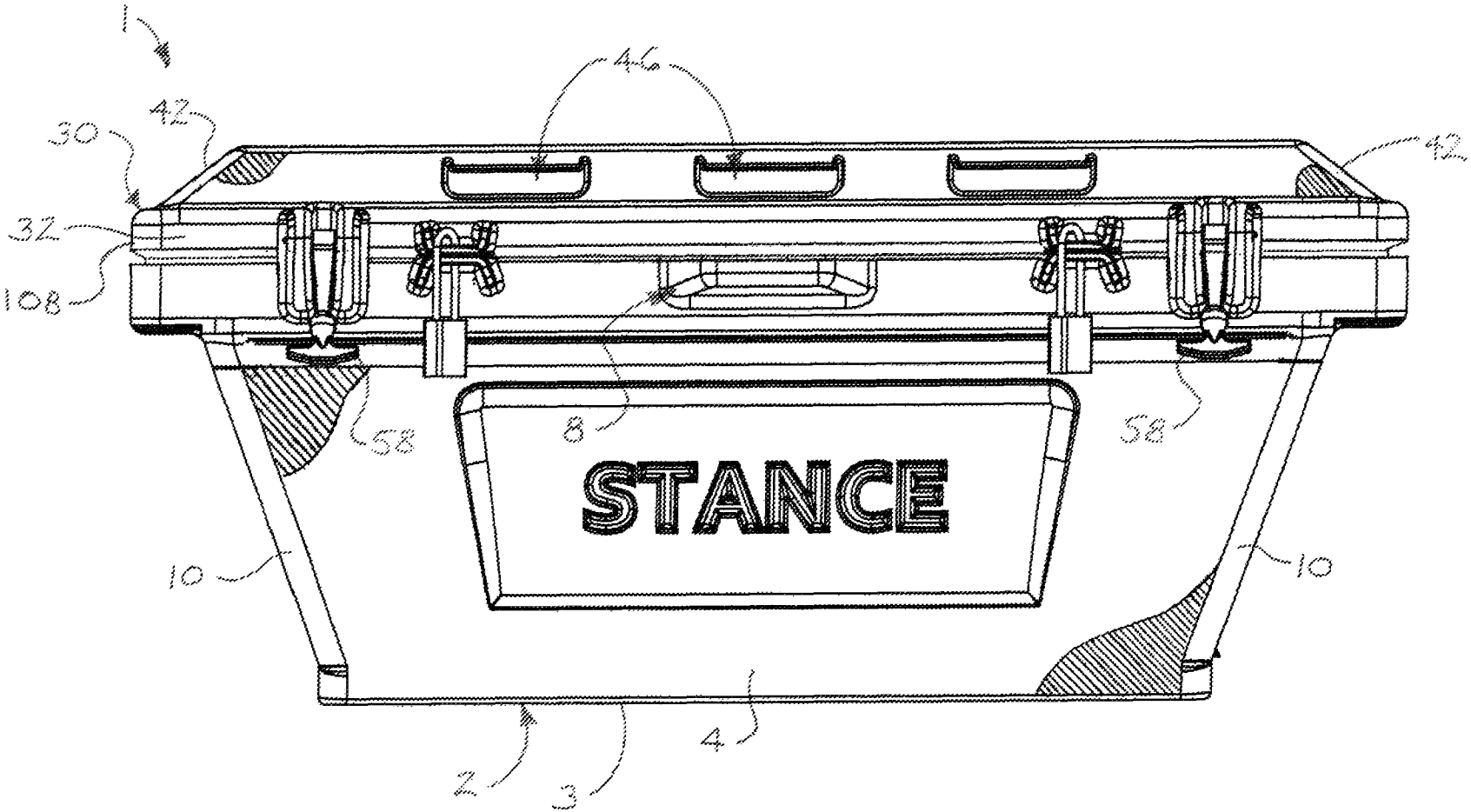
FIG. 28 is a front view of the illustrative nestable sunshade cooler illustrated in FIG. 27.
Figure 29:
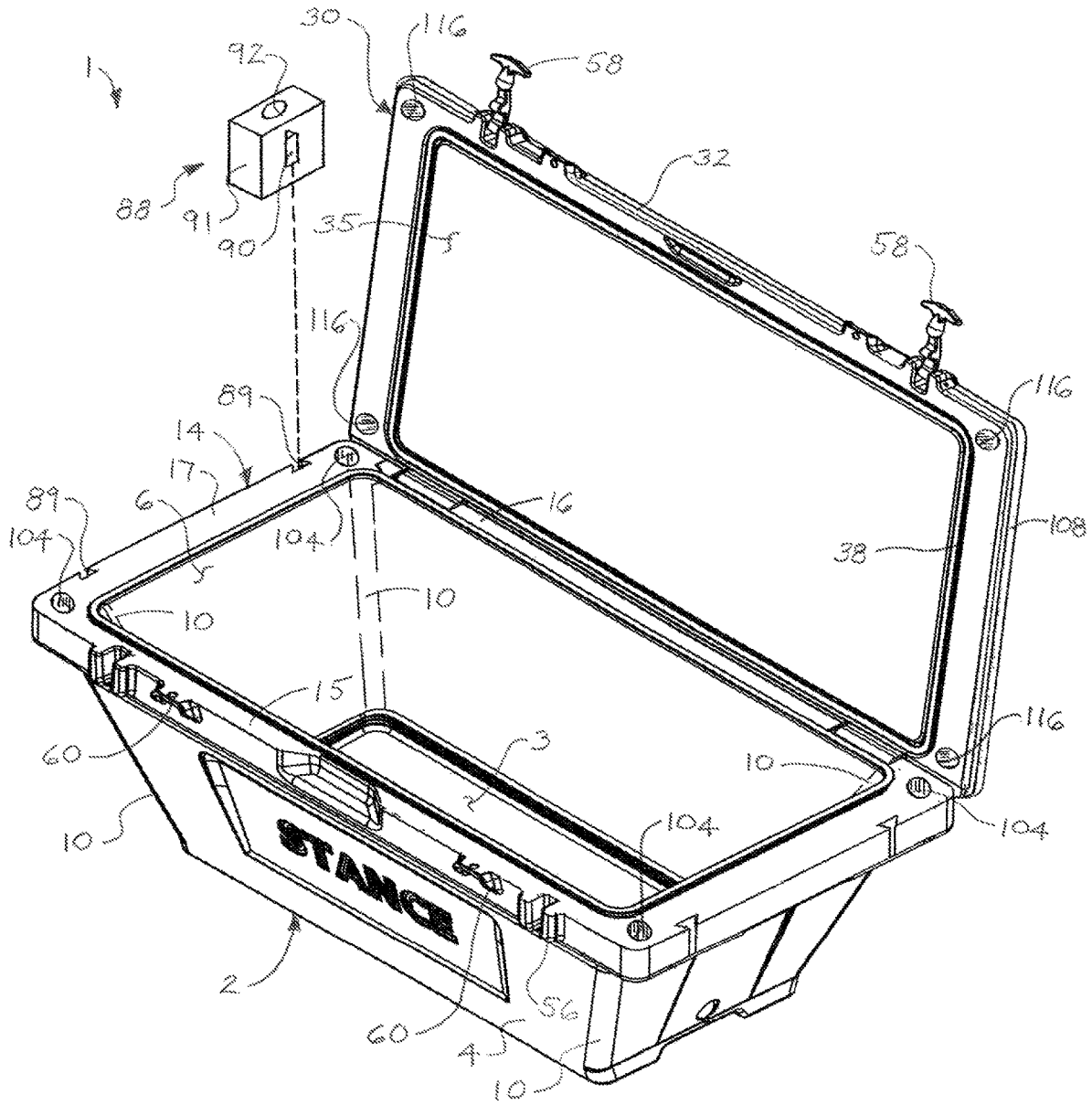
FIG. 29 is a front exploded perspective view of the illustrative nestable sunshade cooler in the open position, more particularly illustrating typical engagement of an accessory holder mount flange on an accessory holder of an accessory mount assembly with a vertical flange slot in the side rim segment of the enclosure rim.

Referring next to FIG. 26 of the drawings, in some embodiments, the accessory mount assembly 88 may include at least one vertical flange slot 89 provided in the enclosure rim 14 of the cooler enclosure 2. In some embodiments, at least one vertical flange slot 89 may be provided in at least one of the side rim segments 17 of the enclosure rim 14, as illustrated. In other embodiments, at least one vertical flange slot 89 may be provided in at least one of the front rim segment 15 and the rear rim segment 16 of the enclosure rim 14. Accordingly, the accessory holder mount flange 90 on the accessory holder 91 may slidably engage the flange slot 89 to facilitate attachment of the accessory holder 91 to the enclosure rim 14. The fishing rod 94 (FIG. 19) and/or other accessory may then be placed in the accessory opening 92 in the accessory holder 91, as was heretofore described with respect to FIG. 19.

Figure 23:
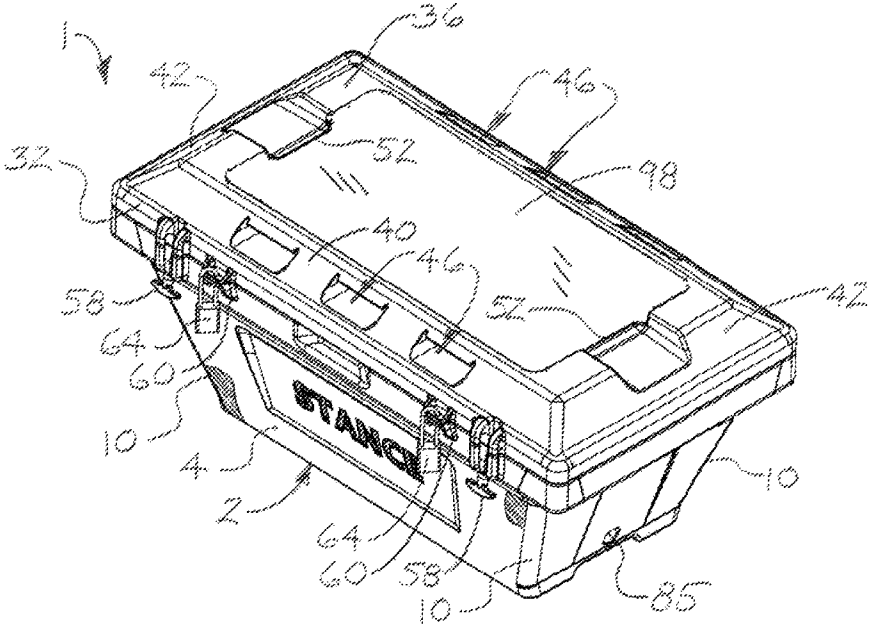
FIG. 23 is a front perspective view of the nestable sunshade cooler with the cutting board stowed in place in the lid cavity.
Figure 22:
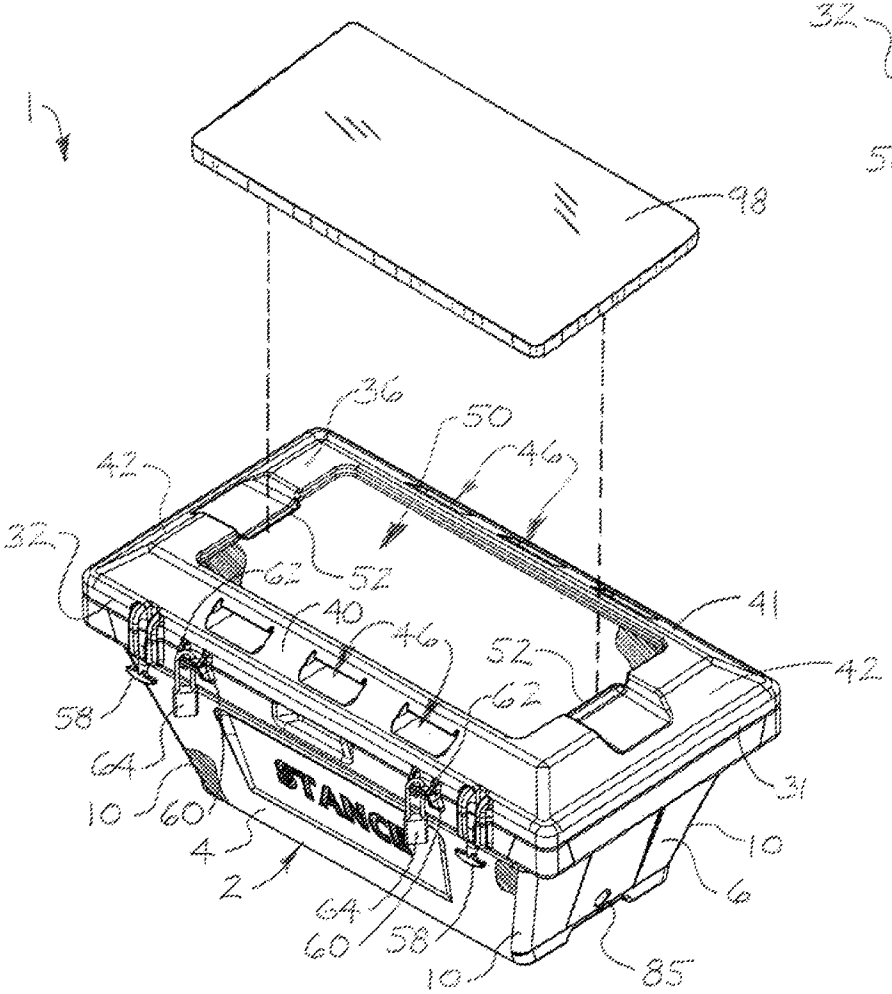
FIG. 22 is an exploded front perspective view of the illustrative nestable sunshade cooler, more particularly illustrating typical stowage of a cutting board in a lid cavity in the cooler lid of the cooler.

Referring next to FIGS. 22 and 23 of the drawings, it will be appreciated by those skilled in the art that in some applications of the nesting cooler 1, a cutting board 98 may be placed into the lid cavity 50 in the outer lid surface 36 of the cooler lid 30. The ends of the cutting board 98 may be inserted beneath the respective retainer flanges 52 typically at opposite ends of the lid cavity 50 to retain and secure the cutting board 98 in the lid cavity 50 until use of the cutting board 98 is desired. The cutting board 98 may be selectively removed from the lid cavity 50 for use typically by disengaging the retainer flanges 52 from the cutting board 98 and removing the cutting board 98 from the lid cavity 50. Other items such as a jacket or other clothing (not illustrated) or the like may be placed in the lid cavity 50 and typically secured using the retainer flange or flanges 52 for stowage in like manner.

In typical application of the nestable sunshade coolers 1, multiple cooler enclosures 2 may be stacked and nested within each other to save space on a retail shelf (not illustrated) or on a shelf in a storage facility (not illustrated) selected by an end user. Accordingly, the cooler lid 30 of each nestable sunshade cooler 1 may be detached from the cooler enclosure 2 typically by initial removal of the corner inserts 20 from the respective corner insert cavities 26 between the rear rim segment 16 and the respective side rim segments 17 of the enclosure rim 14, as illustrated in FIG. 13. This step may expose and facilitate removal of the hinge pin or pins 73 from the sleeve openings 70 in the respective hinge pin sleeves 69 on the cooler lid 30 and registering pin opening or openings 72 in the rear rim segment 16 of the enclosure rim 14 in disassembly of the hinge assembly 68, as illustrated in FIG. 13. Any number of the cooler enclosures 2 may then be stacked and nested within one another, as illustrated in FIGS. 14 and 15, typically by lowering the enclosure bottom panel 3 of each upper cooler enclosure 2 inside the enclosure interior 12 of the next lower cooler enclosure 2. Thus, the enclosure front panel 4, the enclosure rear panel 5 and the enclosure side panels 6 of each upper cooler enclosure 2 may engage or be disposed adjacent to the respective enclosure front panel 4, enclosure rear panel 5 and enclosure side panels 6 of the next lower cooler enclosure 2.

At the point-of-use of the nestable sunshade cooler 1, the cooler lid 30 may be re-attached to the cooler enclosure 2 by re-assembling the hinge assembly 68 typically as was heretofore described with respect to FIG. 13. Various foods, beverages and/or other items (not illustrated) may be placed in the enclosure interior 12 to maintain the items typically in a cold or cool condition. Ice and/or other cooling medium (not illustrated) may be placed in the enclosure interior 12 to cool the items placed therein. The cooler lid 30 may be pivoted to the closed position and secured in place on the cooler enclosure 2 typically by engagement of each lid lock handle 58 on the cooler lid 30 with the corresponding companion lock handle slot 56 in the cooler enclosure 2. As illustrated in FIGS. 1 and 2, a padlock 64 may be extended through registering padlock openings (not illustrated) in the respective enclosure lock flange 60 and lid lock flange 62 and secured to lock the cooler lid 30 in the closed position on the cooler enclosure 2.

In the event that ice (not illustrated) melts and forms liquid water in the enclosure interior 12, the melted water may fall through the drain panel openings 82 (FIG. 18) in the drain panel body 81 of the drain panel 80 and into the underlying drain trough 78 of the drain assembly 76. The melted water may then be drained from the drain trough 78 through the drain opening 84 (FIG. 13) in the enclosure side panel 6 of the cooler enclosure 2.

As was heretofore described with respect to FIGS. 19-21, in some applications, at least one accessory mount assembly 88 may be provided on the cooler enclosure 2 to support at least one fishing rod 94 and/or other accessory preparatory to use. Accordingly, one of the corner inserts 20 may be removed from its corresponding corner insert cavity 26 to expose the open slot end of the flange slot 89 into which the accessory holder mount flange 90 on the accessory holder 91 is to be inserted. The accessory holder mount flange 90 on the accessory holder 91 may then be inserted into the flange slot 89 through the exposed slot end thereof. The corner insert 20 may then be reinserted into the corner insert cavity 26 and the fishing rod 94 and/or other accessory typically placed in the accessory opening 92 in the accessory holder 91. The fishing rod 94 may be readily retrieved from the accessory holder 91 typically by removing the fishing rod handle 95 from the accessory opening 92 in the accessory holder 91. After use of the fishing rod 94, the fishing rod handle 95 may again be inserted in the accessory opening 92 in the accessory holder 91 for temporary stowage until subsequent use.

It will be appreciated by those skilled in the art that the corner inserts 20 may be locked into and irretrievable from the respective corner insert cavities 26 as long as the cooler lid 30 remains in the closed position on the cooler enclosure 2. Accordingly, the accessory holder 91 of the accessory mount assembly 88 cannot be removed from the flange slot 89 since the corner inserts 20 block the open slot ends of the flange slot 89 which would otherwise facilitate removal of the accessory holder mount flange 90 from the flange slot 89. This expedient may lock and secure the accessory holder mount flange 90 of the accessory holder 91 in the flange slot 89 to prevent unauthorized removal of the accessory holder 91 from the cooler enclosure 2.

As was heretofore described with respect to FIGS. 22 and 23, in some applications, a cutting board 98 may be inserted and secured in the lid cavity 50 in the outer lid surface 36 of the cooler lid 30. Accordingly, the retainer flanges 52 may engage the respective ends or sides of the cutting board 98 to retain the cutting board 98 in the lid cavity 50. The cutting board 98 may be selectively removed from the lid cavity 50 by disengaging the retainer flanges 52 from the cutting board 98. Additional or alternative items such as a jacket or other clothing (not illustrated) or the like may be placed in the lid cavity 50 and secured using the retainer flange or flanges 52 for stowage in like manner.

Figure 25:
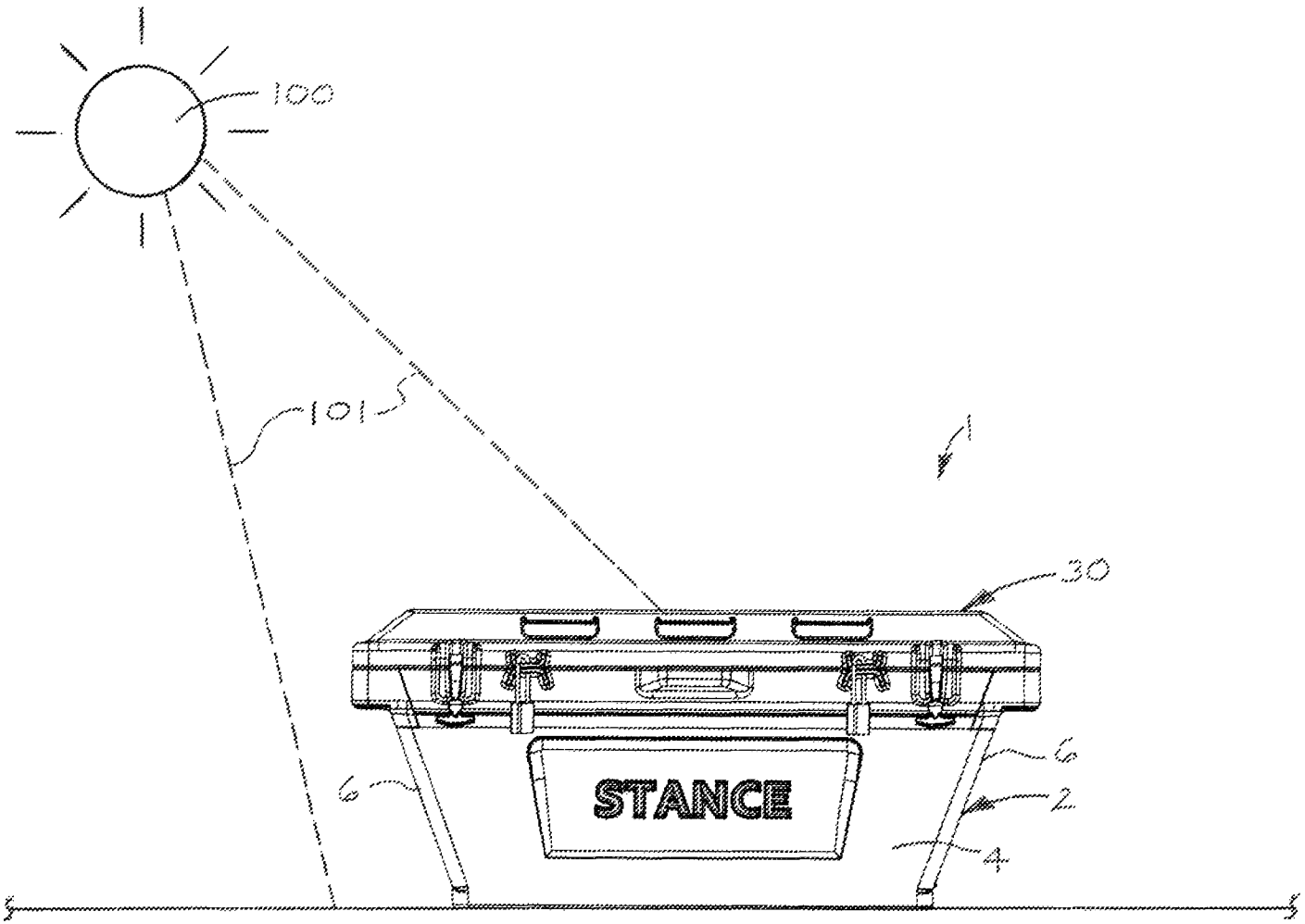
FIG. 25 is a front view of the illustrative nestable sunshade cooler, more particularly illustrating a sun-shading effect of the enclosure front panel, the enclosure side panels and the enclosure rear panel in reducing direct impingement of sunlight on the respective front, side and rear surfaces of the cooler.

Referring next to FIG. 25 of the drawings, it will be appreciated by those skilled in the art that the angled orientation of the enclosure front panel 4, the enclosure rear panel 5 and the enclosure side panels 6 of the cooler enclosure 2 may substantially block and prevent the sunlight 101 from contacting the front, rear and side surfaces of the cooler enclosure 2, particularly during the hottest part of the day when the sun 100 is overhead. This expedient may substantially enhance and prolong the cooling capability of the nesting cooler 1. Consequently, food and/or beverage contained in the enclosure interior 12 of the cooler enclosure 2 may remain frozen or cold for a longer period of time as compared to such items which are contained in a conventional cooler having straight front, rear and side walls.

Figure 30:
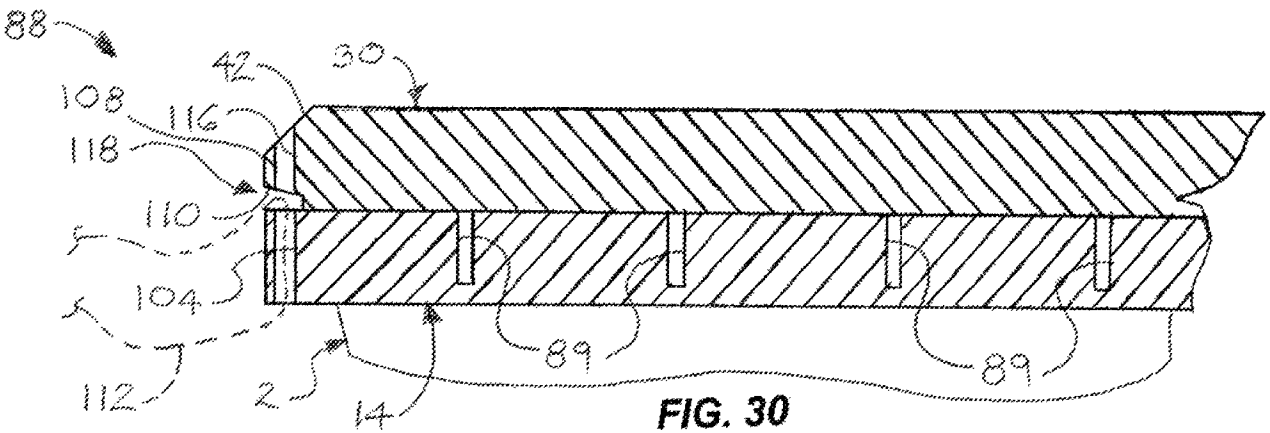
FIG. 30 is an enlarged sectional view, taken along section line 30 in FIG. 28, more particularly illustrating a lid gap between the enclosure rim and the cooler lid and a rim opening in the enclosure rim and a registering lid opening in the cooler lid, further illustrating extension of a tether line (illustrated in phantom) through the rim opening and the lid opening.
Figure 31:
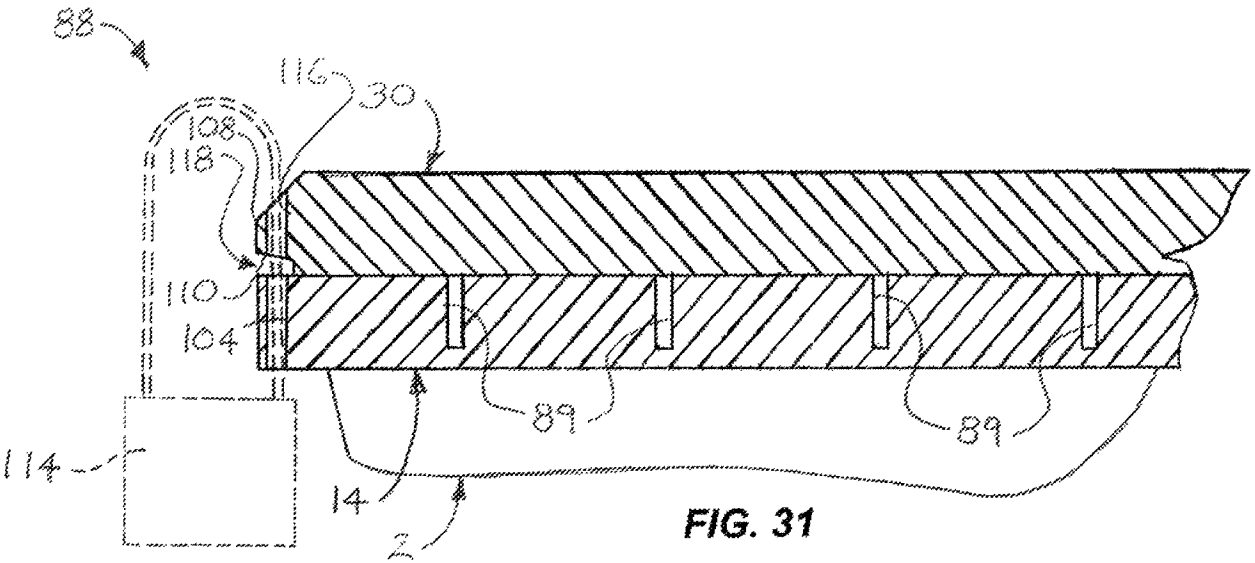
FIG. 31 is an enlarged sectional view, also taken along section line 30 in FIG. 28, illustrating extension of a padlock (illustrated in phantom) through the rim opening and the lid opening to lock the cooler lid in the closed position on the cooler enclosure.

Referring next to FIGS. 27-31 of the drawings, in some embodiments, the accessory mount assembly 88 may include at least one rim opening 104 which extend through the enclosure rim 14 of the cooler enclosure 2. In some embodiments 4 rim openings 104 may extend through the respective corners of the enclosure rim 14, as illustrated. Lid openings 116 may extend through the cooler lid 30. As illustrated in FIGS. 30 and 31, when the cooler lid 30 is closed on the enclosure rim 14 of the cooler enclosure 2, the lid openings 116 in the cooler lid 30 may align or register with the respective rim openings 104 in the enclosure rim 14.

A continuous lid lip 108 may extend from the front lid edge 32, the rear lid edge 33 and the side lid edges 34 of the cooler lid 30. As illustrated in FIGS. 30 and 31, the underside of the lid lip 108 may have an interior lid bevel 110. Accordingly, when the cooler lid 30 is closed on the cooler enclosure 2, a continuous lid gap 118 may be formed by and between the enclosure rim 14 and the interior lid bevel 110 of the lid lip 108. Each rim opening 104 and corresponding registering lid opening 116 may communicate with each other through the lid gap 118. Accordingly, as illustrated in FIG. 30, in some applications, a tether line 112 (illustrated in phantom) may be threaded through a rim opening 114, a lid opening 116, or both to facilitate attachment of an accessory (not illustrated) to the nestable sunshade cooler 1. Additionally or alternatively, as illustrated in FIG. 31, in some applications, a padlock 114 may be extended through one of the registering pairs of the rim openings 114 and lid openings 116 and locked to lock the cooler lid 30 in the closed position on the cooler enclosure 2. As further illustrated in FIG. 29, in some embodiments, the accessory mount assembly 88 may further include the flange slot or slots 89 in the enclosure rim 14. One or more accessory holder or holders 91 can be attached to a selected one of the flange slots 89 by insertion of the accessory holder mount flange 90 into a corresponding companion flange slot 89, as was heretofore described with respect to FIG. 26.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A nestable sunshade cooler, comprising:

a cooler enclosure including:

an enclosure bottom panel;

a pair of spaced-apart enclosure side panels extending from the enclosure bottom panel;

an enclosure front panel and an enclosure rear panel extending from the enclosure bottom panel in spaced-apart relationship to each other between the pair of spaced-apart enclosure side panels;

a plurality of enclosure corners joining the pair of spaced-apart enclosure side panels to the enclosure front panel and the enclosure rear panel to the pair of spaced-apart enclosure side panels, respectively;

an enclosure rim on the pair of spaced-apart enclosure side panels, the enclosure front panel and the enclosure rear panel; and the pair of spaced-apart enclosure side panels, the enclosure front panel and the enclosure rear panel angle outwardly from the enclosure bottom panel to the enclosure rim to form a substantially trapezoidal shape in longitudinal sectional view and cross-sectional view of the cooler enclosure, whereby multiple ones of the cooler enclosure are capable of nesting inside one another;

at least one accessory mount assembly carried by the cooler enclosure, the at least one accessory mount assembly suitably configured to removably mount at least one accessory on the cooler enclosure; and a cooler lid selectively detachably carried by and deployable between open and closed positions on the cooler enclosure to open and close the enclosure interior, the cooler lid including:

a cooler lid panel having a front lid edge, a rear lid edge, side lid edges, an inner lid surface and an outer lid surface;

at least one lid cavity recessed in the outer lid surface of the cooler lid panel, the at least one lid cavity sized and configured to contain at least one cutting board; and at least one flexible retainer flange on the outer lid surface of the cooler lid, the at least one flexible retainer flange protruding over the at least one lid cavity, the at least one flexible retainer flange configured to removably retain the at least one cutting board in the at least one lid cavity.

2. The nestable sunshade cooler of claim 1 wherein the at least one accessory mount assembly comprises at least one flange slot in the cooler enclosure, at least one accessory holder mount flange interfacing with the at least one flange slot and at least one accessory holder carried by the at least one accessory holder mount flange, the at least one accessory holder suitably configured to hold the at least one accessory.

3. The nestable sunshade cooler of claim 2 further comprising at least one accessory opening in the at least one accessory holder, the at least one accessory opening suitably configured to accommodate the at least one accessory.

4. The nestable sunshade cooler of claim 1 further comprising at least one rim opening extending through the enclosure rim and at least one lid opening extending through the cooler lid, and the at least one lid opening registers with the at least one rim opening, respectively, in the closed position of the cooler lid on the cooler enclosure.

5. The nestable sunshade cooler of claim 4 further comprising a continuous lid lip extending from the cooler lid, an Interior lid bevel on the lid lip and a continuous lid gap formed by and between the enclosure rim and the interior lid bevel of the lid lip when the cooler lid is in the closed position on the cooler enclosure, the lid bevel facing the enclosure rim across the lid gap.

6. The nestable sunshade cooler of claim 1 further comprising a plurality of corner insert cavities in the enclosure rim at the plurality of enclosure corners, respectively, of the cooler enclosure and a plurality of corner inserts removably deployed in the plurality of corner insert cavities, respectively, and wherein the enclosure rim comprises a front rim segment carried by the enclosure front panel, a rear rim segment carried by the enclosure rear panel and a pair of side rim segments carried by the pair of enclosure side panels, respectively, of the cooler enclosure, and wherein the plurality of corner insert cavities is provided between the front rim segment and the pair of side rim segments, respectively, and between the rear rim segment and the pair of side rim segments, respectively, and a plurality of insert flange openings in the cooler enclosure at the plurality of corner insert cavities, respectively, and wherein the plurality of corner inserts each comprises an insert body and an elongated insert flange extending from the insert body, the insert flange sized and configured for insertion into a corresponding one of the plurality of insert flange openings.

7. The nestable sunshade cooler of claim 1 further comprising at least one drain assembly including at least one drain trough communicating with the enclosure interior of the cooler enclosure, at least one drain panel seat communicating with the at least one drain trough and at least one drain panel removably deployed in the at least one drain panel seat, the at least one drain panel having a plurality of drain panel openings establishing communication between the at least one drain trough and the enclosure interior of the cooler enclosure.

8. A nestable sunshade cooler, comprising:

a cooler enclosure including:

an enclosure bottom panel;

a pair of spaced-apart enclosure side panels extending from the enclosure bottom panel;

an enclosure front panel and an enclosure rear panel extending from the enclosure bottom panel in spaced-apart relationship to each other between the pair of spaced-apart enclosure side panels;

a plurality of enclosure corners joining the pair of spaced-apart enclosure side panels to the enclosure front panel and the enclosure rear panel to the pair of spaced-apart enclosure side panels, respectively;

an enclosure rim on the pair of spaced-apart enclosure side panels, the enclosure front panel and the enclosure rear panel; and the pair of spaced-apart enclosure side panels, the enclosure front panel and the enclosure rear panel angle outwardly from the enclosure bottom panel to the enclosure rim to form a substantially trapezoidal shape in longitudinal sectional view and cross-sectional view of the cooler enclosure, whereby multiple ones of the cooler enclosure are capable of nesting inside one another;

a cooler lid selectively detachably carried by and deployable between open and closed positions on the cooler enclosure to open and close the enclosure interior, the cooler lid including:

a cooler lid panel having a front lid edge, a rear lid edge, side lid edges, an inner lid surface and an outer lid surface;

at least one lid cavity recessed in the outer lid surface of the cooler lid panel, the at least one lid cavity sized and configured to contain at least one cutting board;

an elongated front lid ridge angling upwardly from the front lid edge to the outer lid surface;

a beveled rear lid ridge angling upwardly from the rear lid edge to the outer lid surface;

a pair of beveled side lid ridges angling upwardly from the side lid edges, respectively, to the outer lid surface, the at least one lid cavity extending into the outer lid surface between the front lid ridge, the rear lid ridge and the side lid rides; and at least one flexible retainer flange on the cooler lid adjacent to at least one of the front lid ridge, the rear lid ridge and at least one of the side lid ridges, the at least one flexible retainer flange protruding over the at least one lid cavity; and at least one cutting board removably disposed in the at least one lid cavity, the at least one flexible retainer flange removably retaining the at least one cutting board in the at least one lid cavity.

9. The nestable sunshade cooler of claim 8 further comprising a plurality of corner insert cavities in the enclosure rim at the plurality of enclosure corners, respectively, of the cooler enclosure and a plurality of corner inserts removably inserted in the plurality of corner insert cavities, respectively, and wherein the enclosure rim comprises a front rim segment carried by the enclosure front panel, a rear rim segment carried by the enclosure rear panel and a pair of side rim segments carried by the pair of spaced-apart enclosure side panels, respectively, of the cooler enclosure, and wherein the plurality of corner insert cavities is provided between the front rim segment and the pair of side rim segments, respectively, and between the rear rim segment and the pair of side rim segments, respectively.

10. The nestable sunshade cooler of claim 9 further comprising a plurality of insert flange openings in the cooler enclosure at the plurality of corner insert cavities, respectively, and wherein the plurality of corner inserts each comprises an insert body and an elongated insert flange extending from the insert body, the insert flange sized and configured for insertion into a corresponding one of the plurality of insert flange openings.

11. The nestable sunshade cooler of claim 8 further comprising at least one rim opening extending through the enclosure rim and at least one lid opening extending through the cooler lid, and the at least one lid opening registers with the at least one rim opening, respectively, in the closed position of the cooler lid on the cooler enclosure.

12. The nestable sunshade cooler of claim 8 further comprising a continuous lid lip extending from the cooler lid, an interior lid bevel on the lid lip and a continuous lid gap formed by and between the enclosure rim and the interior lid bevel of the lid lip when the cooler lid is in the closed position on the cooler enclosure, the lid bevel facing the enclosure rim across the lid gap.

13. The nestable sunshade cooler of claim 8 further comprising:

at least one accessory mount assembly carried by the enclosure rim of the cooler enclosure, the at least one accessory mount assembly suitably configured to removably mount at least one accessory on the cooler enclosure and including:

at least one flange slot in the enclosure rim;

at least one accessory holder mount flange interfacing with the at least one flange slot;

at least one accessory holder carried by the at least one accessory holder mount flange, the at least one accessory holder suitably configured to hold the at least one accessory; and at least one accessory opening in the accessory holder, the at least one accessory opening suitably configured to accommodate the at least one accessory.

14. The nestable sunshade cooler of claim 8 further comprising at least one drain assembly including at least one drain trough communicating with the enclosure interior of the cooler enclosure, at least one drain panel seat communicating with the at least one drain trough and at least one drain panel removably deployed in the at least one drain panel seat, the at least one drain panel having a plurality of drain panel openings establishing communication between the at least one drain trough and the enclosure interior of the cooler enclosure.

15. A nestable sunshade cooler, comprising:

a cooler enclosure including:

an enclosure bottom panel;

a pair of spaced-apart enclosure side panels extending from the enclosure bottom panel;

an enclosure front panel and an enclosure rear panel extending from the enclosure bottom panel in spaced-apart relationship to each other between the pair of spaced-apart enclosure side panels;

a plurality of enclosure corners joining the pair of spaced-apart enclosure side panels to the enclosure front panel and the enclosure rear panel to the pair of spaced-apart enclosure side panels, respectively;

an enclosure rim on the pair of spaced-apart enclosure side panels, the enclosure front panel and the enclosure rear panel, the enclosure rim including:

a front rim segment carried by the enclosure front panel;

a rear rim segment carried by the enclosure rear panel; and a pair of side rim segments carried by the pair of spaced-apart enclosure side panels, respectively, of the cooler enclosure; and the pair of spaced-apart enclosure side panels, the enclosure front panel and the enclosure rear panel angle outwardly from the enclosure bottom panel to the enclosure rim to form a substantially trapezoidal shape in longitudinal sectional view and cross-sectional view of the cooler enclosure, whereby multiple ones of the cooler enclosures are capable of nesting inside one another;

a cooler lid selectively detachably carried by and deployable between open and closed positions on the cooler enclosure to open and close the enclosure interior, the cooler lid including:

a cooler lid panel having a front lid edge, a rear lid edge, side lid edges, an inner lid surface and an outer lid surface;

at least one lid cavity recessed in the outer d surface of the cooler lid panel, the at least one lid cavity sized and configured to contain at least one cutting board; and at least one flexible retainer flange on the outer lid surface of the cooler lid, the at least one flexible retainer flange protruding over the at least one lid cavity, the at least one flexible retainer flange configured to removably retain the at least on cutting board in the at least one lid cavity;

at least one accessory mount assembly carried by the cooler enclosure, the at least one accessory mount assembly suitably configured to removably mount at least one accessory and including:

a plurality of flange slots in the front rim segment, the rear rim segment and the pair of side rim segments, respectively, of the enclosure rim on the cooler enclosure;

at least one accessory holder mount flange interfacing with at least one of the plurality of flange slots;

at least one accessory holder carried by the at least one accessory holder mount flange, the at least one accessory holder suitably configured to hold the at least one accessory;

a continuous lid lip extending from the cooler lid, an interior lid bevel on the lid lip and a continuous lid gap formed by and between the enclosure rim and the interior lid bevel of the lid lip when the cooler lid is in the closed position on the cooler enclosure, the lid bevel facing the enclosure rim across the lid gap; and at least one rim opening extending through the enclosure rim and at least one lid opening extending through the cooler lid, and the at least one lid opening registers with the at least one rim opening, respectively, in the closed position of the cooler lid on the cooler enclosure.

16. The nestable sunshade cooler of claim 15 further comprising at least one accessory opening in the accessory holder, the at least one accessory opening suitably configured to accommodate the at least one accessory.

17. The nestable sunshade cooler of claim 15 further comprising a plurality of corner insert cavities in the enclosure rim at the plurality of enclosure corners, respectively, of the cooler enclosure between the front rim segment and the pair of side rim segments, respectively, and between the rear rim segment and the pair of side rim segments, respectively; a plurality of corner inserts removably inserted in the plurality of corner insert cavities, respectively; and wherein the cooler lid is selectively deployable between open and closed positions on the cooler enclosure to open and close the enclosure interior, the cooler lid secures the plurality of corner inserts in the plurality of corner insert cavities, respectively, in the closed position of the cooler lid.

18. The nestable sunshade cooler of claim 15 further comprising at least one lock handle slot in the enclosure rim of the cooler enclosure and at least one lid lock handle on the cooler lid panel of the cooler lid, the at least one lid lock handle positionally interfacing with and configured for insertion into the at least one enclosure lock flange to secure the cooler lid in the closed position on the cooler enclosure.

* * * * *